US007305261B2

(12) United States Patent
Aiga et al.

(10) Patent No.: US 7,305,261 B2
(45) Date of Patent: Dec. 4, 2007

(54) BAND PASS FILTER HAVING RESONATORS CONNECTED BY OFF-SET WIRE COUPLINGS

(75) Inventors: Fumihiko Aiga, Kanagawa (JP); Yoshiaki Terashima, Kanagawa (JP); Hiroyuki Fuke, Kanagawa (JP); Mutsuki Yamazaki, Kanagawa (JP); Tatsunori Hashimoto, Kanagawa (JP); Hiroyuki Kayano, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/838,249

(22) Filed: May 5, 2004

(65) Prior Publication Data

US 2005/0003792 A1 Jan. 6, 2005

(30) Foreign Application Priority Data

May 12, 2003 (JP) ..... 2003-132654

(51) Int. Cl.
*H01P 1/203* (2006.01)
*H01B 12/02* (2006.01)

(52) U.S. Cl. ..... 505/210; 333/99 S; 333/204

(58) Field of Classification Search ..... 333/204, 333/219, 99 S; 505/210, 700, 701, 866
See application file for complete search history.

(56) References Cited

U.S. PATENT DOCUMENTS 3,153,209 A * 10/1964 Kaiser ..... 333/204
4,264,881 A * 4/1981 De Ronde ..... 333/110
4,423,396 A * 12/1983 Makimoto et al. ..... 333/204
4,992,759 A * 2/1991 Giraudeau et al. ..... 333/204

FOREIGN PATENT DOCUMENTS

| | | |
|---|---|---|
| JP | 9-307306 | 11/1997 |
| JP | 11-17405 | 1/1999 |
| JP | 2001-313502 | 11/2001 |
| JP | 2002-76703 | 3/2002 |
| JP | 2003-32004 | 1/2003 |
| WO | WO 02/101872 A1 | 12/2002 |

OTHER PUBLICATIONS

Patent Abstracts of Japan; Applicant: Matshushita Electric Ind Co Ltd; Inventor: Setsune et al; Publication No. 05299914; Publication Date: Nov. 12, 1993; Title: Superconductive High Frequcney Resonator and Filter.*

(Continued)

*Primary Examiner*—Benny T. Lee
(74) *Attorney, Agent, or Firm*—Oblon, Spivak, McClelland, Maier & Neustadt, P.C.

(57) ABSTRACT

A band pass filter which is configured by a microstrip line, or a strip line is provided. The band pass filter has a first half wavelength resonator which resonates at a center frequency of a pass band, a second half wavelength resonator which resonates at the center frequency of the pass band, and a transmission line through which the first half wavelength resonator is wire-coupled to the second half wavelength resonator. A strong coupling can be stably realized without causing deviation of the resonance frequencies of resonators.

16 Claims, 22 Drawing Sheets

OTHER PUBLICATIONS

Gregory L. Hey-Shipton, "Efficient Computer Design of Compact Planar Band-Pass Filters Using Electrically Short Multiple Coupled Lines", IEEE Microwave Theory and Techniques Symposium Digest, 1999, pp. 1547-1550.

Kurt F. Raihn, et al., "Highly Selective HTS Band Pass Filter with Multiple Resonator Cross-Couplings", IEEE Microwave Theory and Techniques Symposium Dighest, 2000, pp. 661-664.

Jia-Sheng Hong, et al., "On The Performance of HTS Microstrip Quasi-Elliptic Function Filters for Mobile Communications Application", IEEE Transactions on Microwave Theory and Techniques, vol. 48, No. 7, Jul. 2000, pp. 1240-1246.

Genichi Tsuzuki, et al., "Ultra Selective 22-Pole, 10-Transmission Zero Superconducting Bandpass Filter Surpasses 50-Pole Chebyshev Rejection", IEEE Microwave Theory and Techniques Symposium Digest, 2002, pp. 1963-1966.

Genichi Tsuzuki, et al., "Ultra Selective 22-Pole 10-Transmission Zero Superconducting Bandpass Filter Surpasses 50-Pole Chebyshev Filter", IEEE Transactions on Microwave Theory and Techniques, vol. 50, No. 12, Dec. 2002, pp. 2924-2929.

Jia-Sheng Hong, et al., "Transmission Line Filters with Advanced Filtering Characteristics", IEEE Microwave Theory and Techniques Symposium Digest, 2000, pp. 319-322.

U.S. Appl. No. 10/838,249 filed May 5, 2004, Aiga et al.

U.S. Appl. No. 11/688,525 filed Mar. 20, 2007, Aiga et al.

* cited by examiner

BAND PASS FILTER HAVING RESONATORS CONNECTED BY OFF-SET WIRE COUPLINGS

BACKGROUND OF THE INVENTION

1. Field of the Invention

The present invention relates to a band pass filter which is useful in a communication apparatus.

2. Description of the Related Art

A communication apparatus which performs information communications by radio or wire is configured by various high-frequency components such as an amplifier, a mixer, and a filter. Among such components, a band pass filter has a function of allowing only a signal of a specific frequency band to pass through the filter. Some of such band pass filters are configured by arranging a plurality of resonators.

In a planar circuit configured by a microstrip line, a strip line, or the like, a coupling between resonators constituting a filter is usually defined only by positional relationships between the resonators, and realized without using a coupling element in addition to the resonators. This coupling method is suitable for a filter configured only by a coupling between adjacent resonators, such as a usual Chebyshev function type filter. In the case where a filter circuit having a cross coupling for a steepening of the skirt characteristic due to an attenuation pole or a flattening of the group delay time is to be realized, the coupling method has a problem that undesired couplings are easily generated in addition to a desired coupling between resonators.

On the other hand, the following documents (1) to (5) cited below disclose a method in which the cross coupling for a steepening of the skirt characteristic is realized by addition of a coupling line. In the coupling method, the ends of the coupling line are placed at positions where are close to two resonators and separated by a certain distance therefrom, whereby a coupling between the resonators is realized. In the following document (6), the electric length of a coupling line is variously changed to realize the flattening of the group delay time or the steepening of the skirt characteristic due to an attenuation pole. In the following documents (1) to (3), a quarter-wavelength coupling line is used. However, the techniques disclosed in the documents have a problem that parasitic couplings are easily generated between the ends of the coupling line and the resonators, and the resonance frequencies of the resonators are effectively deviated. In order to attain a strong coupling, the distances between the coupling line and the resonators must be very short. This causes another problem that a stable coupling cannot be obtained.

(1) JP-A-11-17405, (2) JP-A-2001-313502, and (3) JP-A-2002-76703 are referred to as related art.

Further, (4) IEEE Microwave Theory and Techniques Symposium Digest (1999), p. 1,547, (5) IEEE Microwave Theory and Techniques Symposium Digest (2000), p. 661, (6) IEEE Transactions on Microwave Theory and Techniques, No. 48 (2000), p. 1,240, (7) IEEE Microwave Theory and Techniques Symposium Digest (2002), p. 1,963, (8) IEEE Transactions on Microwave Theory and Techniques, No. 50 (2002), p. 2,924, and (9) IEEE Microwave Theory and Techniques Symposium Digest (2000), p. 319 are also referred to as related art.

As described above, in a coupling between resonators using a coupling line in a filter circuit, it is very difficult to prevent the resonance frequencies of the resonators from being deviated. Furthermore, it is impossible to stably realize a strong coupling.

SUMMARY OF THE INVENTION

The invention provides a band pass filter having: a first resonator for resonating at a center frequency of a pass band; a second resonator for resonating at the center frequency; and a first transmission line for wire-coupling between said first resonator and said second resonator, wherein a first connecting position of said first resonator and said first transmission line is connected to another position of a center of said first resonator, or a second connecting position of said second resonator and said first transmission line is connected to another position of a center of said second resonator.

Furthermore, said first resonator and said second resonator are half wavelength resonators.

Furthermore, said first transmission -line resonates at a frequency which is 2/(2n−1) times higher than the center frequency (where n is a natural number).

Furthermore, an electric length of said first transmission line is (2n−1)/4 times a wavelength corresponding to the center frequency (where n is a natural number).

Furthermore, said first connecting position and said second connecting position are placed on an inside with respect to the respective centers.

Furthermore, said first connecting position is placed on an inside with respect to the center of said first resonator, and said second connecting position is placed on an outside with respect to the center of said second resonator.

Furthermore, said first connecting position and said second connecting position are placed on an outside with respect to the respective centers.

Furthermore, said first connecting position is placed on an outside with respect to the center of said first resonator, and said second connecting position is placed on an inside with respect to the center of said second resonator.

Furthermore, a coupling strength is changed in accordance with a distance between the center of said first resonator and said first connecting position.

Furthermore, a coupling strength is changed in accordance with a distance between the center of said second resonator and said second connecting position.

Furthermore, said first resonator and said second resonator are coupled to each other only through said first transmission line.

Furthermore, at least one of said first resonator and said second resonator is formed by a superconducting member.

The band pass filter further has: third and fourth resonators, which are placed between said first resonator and said second resonator, for resonating at the center frequency.

The band pass filter further has: a second transmission line for wire-coupling between said third resonator and said fourth resonator.

Furthermore, each of said first resonator and said second resonator has a dielectric substrate, and a line formed on a principal surface of said dielectric substrate, and at least one of said dielectric substrates of said first and second resonators is a sapphire substrate in which a sapphire R-plane is formed as said principal surface.

Furthermore, at said first connecting position and said second connecting position, an angle formed by said first transmission line and a <1-101> direction of the sapphire R-plane is 45°, and angles formed by said first resonator and said second resonator, and the <1-101> direction are 45° or 135°.

The invention also provides a radio communication apparatus having: a band pass filter involving a first resonator for resonating at a center frequency of a pass band, a second resonator for resonating at the center frequency, and a first transmission line for wire-coupling between said first resonator and said second resonator, wherein a first connecting position of said first resonator and said first transmission line is different from a center of said first resonator, or a second connecting position of said second resonator and said first transmission line is different from a center of said second resonator; an antenna for transmitting or receiving a radio signal; and an amplifier connected to said band pass filter.

The radio communication apparatus further has: a low-temperature holding portion for holding said band pass filter to a low temperature, wherein at least one of said first and second resonators of said band pass filter is formed by a superconducting member.

DETAILED DESCRIPTION OF THE PREFERRED EMBODIMENTS

Figure 1:
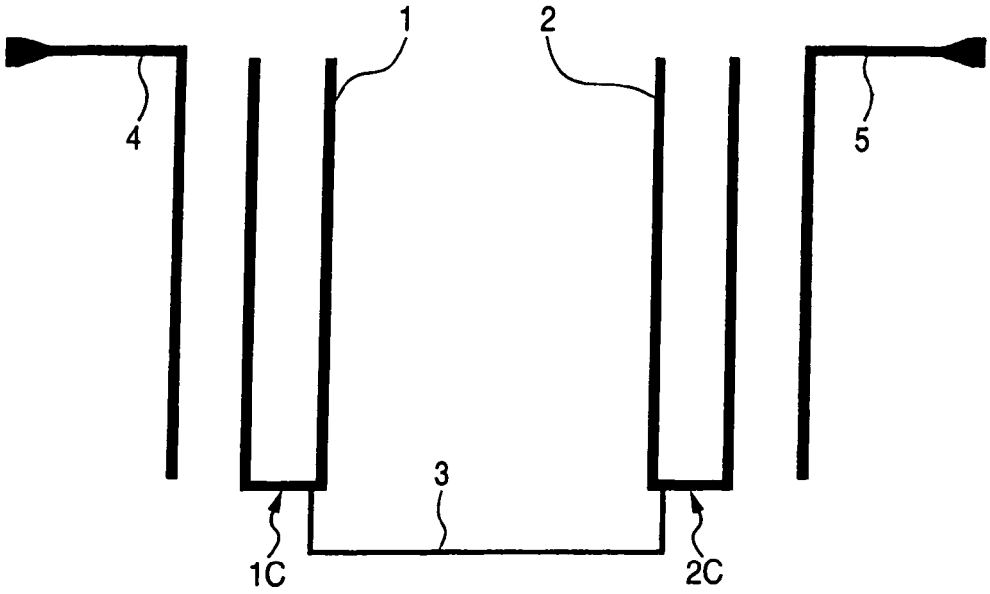
FIG. 1 is a pattern diagram illustrating the basic configuration of a filter circuit of first embodiment.

Embodiments of the invention will be described with reference to the drawings, wherein like reference numerals designate identical or corresponding parts throughout the several views.

First Embodiment

First, an embodiment of the basic configuration of a filter circuit according to the invention will be described.

FIG. 1 is a pattern diagram illustrating the basic configuration of the filter of first embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 1 and 2 are hairpin type half wavelength resonators. The resonance frequency is about 1.93 GHz. The resonators 1 and 2 are wire-coupled to each other through a transmission line 3.

In the specification, the term "wire-coupling" means a direct connection in which no branch is formed and conduction is attained.

In the specification, the position of a conduction point of wire-coupling is expressed by using terms "inside" and "outside". When one set of resonators which are wire-coupled to each other are expressed as a resonator A and a resonator B, the portions between the resonators A and B are defined as "inside", the portions on the sides of input and output ends of the resonators A and B are defined as "outside".

In the embodiment of FIG. 1, the resonators 1 and 2 are wire-coupled to each other, and the portions between the resonators 1 and 2 are on the inside. The portion of the resonator 1 on the side of an excitation portion 4 is on the outside, and that of the resonator 2 on the side of an excitation portion 5 is the outside. More specifically, the portion which is closer to the input and output ends than the center 1C of the resonator 1, i.e., the left side with respect to the center 1C in FIG. 1 is on the outside, and the right side with respect to the center 1C is the inside. In FIG. 1, the connecting position of the resonator 1 and the transmission line 3 is displaced from the center 1C of the resonator 1 toward the right side or on the inside. By contrast, in the resonator 2, the portion where is closer to the input and output end than the center 2C of the resonator 2, i.e., the right side with respect to the center 2C in FIG. 1 is on the outside, and the left side with respect to the center 2C is the inside. In FIG. 1, the connecting position of the resonator 2 and the transmission line 3 is displaced from the center 2C of the resonator 2 toward the left side or on the inside.

In the embodiment, the resonance frequency of the transmission line 3 is about 3.86 GHz. The resonance frequency is about two times the resonance frequencies 1.93 GHz of the resonators 1 and 2.

The excitation portions 4 and 5 are connected to the external. In the circuit of FIG. 1, therefore, the coupling between the resonators 1 and 2 can be measured.

Figure 2:
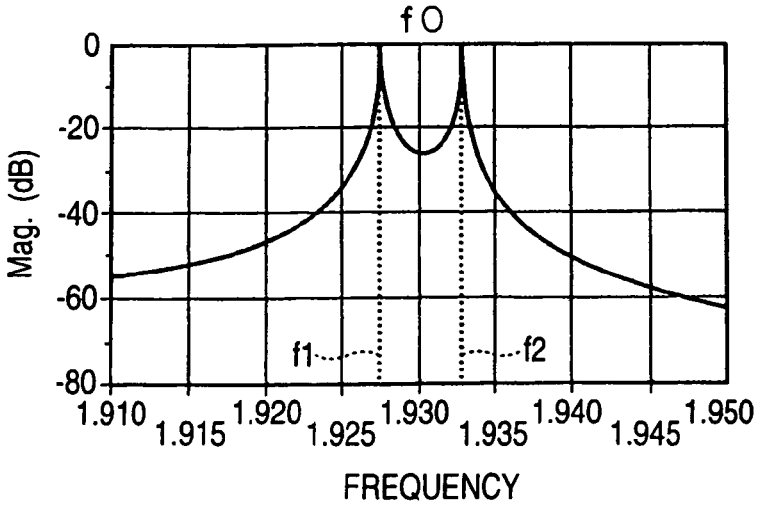
FIG. 2 is a diagram showing the pass amplitude characteristic of the filter circuit of the first embodiment.

FIG. 2 shows the pass amplitude characteristic of the circuit of FIG. 1. The abscissa indicates the frequency (GHz) of the passing signal, and the ordinate indicates the amplitude (dB).

There are two peaks indicating the coupling between the two resonators. Assuming that the frequencies corresponding to the two peaks are respectively indicated by f1 and f2, the center f0 of the two peaks is given by the following equation.

$$f0=(f2+f1)/2$$

The center frequency f0 is about 1.93 GHz, and coincides with the resonance frequencies of the resonators 1 and 2. Conventionally, in a coupling between resonators using a coupling line, it is very difficult to prevent the resonance frequencies of the resonators from deviating. By contrast, in the invention, the resonators are wire-coupled to each other, whereby a coupling is realized without causing the resonance frequency to be deviated. The coupling coefficient M between the resonators 1 and 2 is given by the following equation.

$$M=2(f2-f1)/(f1+f2)$$

Figure 3:
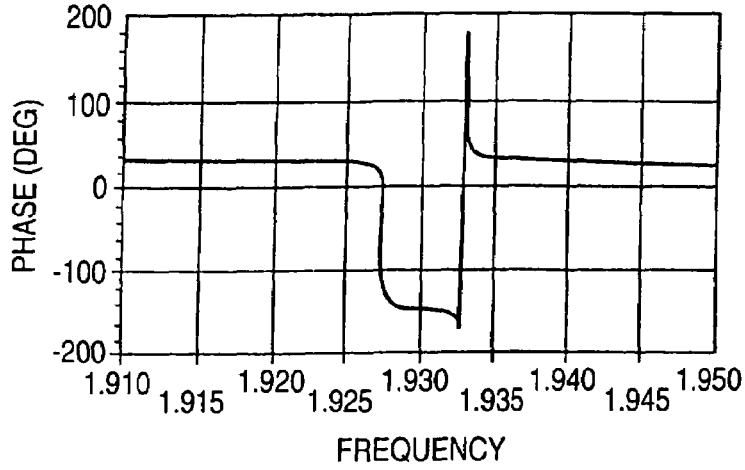
FIG. 3 is a diagram showing the pass phase characteristic of the filter circuit of the first embodiment.

FIG. 3 shows the pass phase characteristic of the circuit of FIG. 1. The abscissa indicates the frequency (GHz) of the passing signal, and the ordinate indicates the phase deviation in terms of an angle (deg).

In FIG. 3, the phase lags in the frequency region corresponding to the interval of the two peaks in FIG. 2. Therefore, it will be seen that, in the circuit of FIG. 1, the coupling between the resonators 1 and 2 due to the transmission line 3 is an electric coupling.

Figure 4:
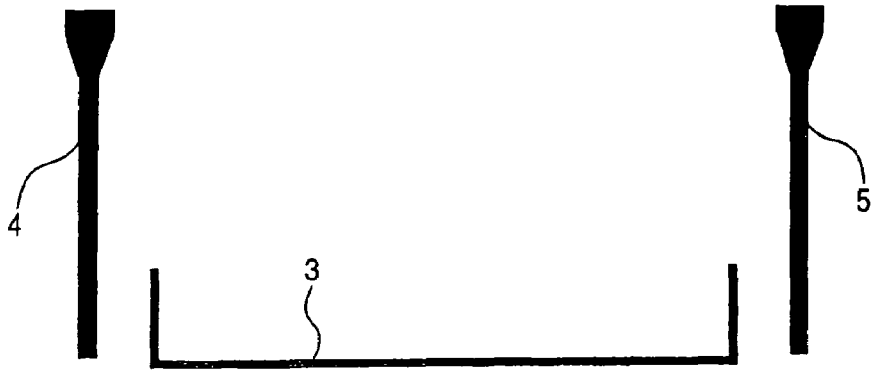
FIG. 4 is a pattern diagram of a circuit for measuring the resonance frequency of a transmission line.

FIG. 4 is a diagram of a circuit for measuring the resonance frequency of the transmission line 3 of FIG. 1. The excitation portions 4 and 5 are connected to the external.

Figure 5:
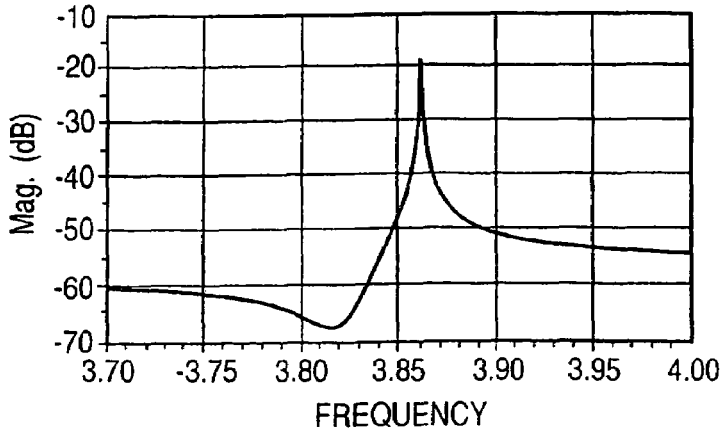
FIG. 5 is a view showing results of measurements of the resonance frequency of the transmission line.

FIG. 5 shows a result of measurement of the resonance frequency of the circuit shown in FIG. 4. The circuit has a resonance frequency of about 3.86 GHz which is two times the resonance frequencies 1.93 GHz of the resonators 1 and 2.

Summarizing the above, when the resonators 1 and 2 are wire-coupled to each other through the transmission line 3 which resonates at a frequency that is two times the resonance frequencies of the resonators 1 and 2, the coupling between the resonators can be realized without causing the resonance frequency to be deviated. When the connecting position of the resonator 1 and the transmission line 3 is displaced toward the inside with respect to the center 1C of the resonator 1, and that of the resonator 2 and the transmission line 3 is displaced toward the inside with respect to the center 2C of the resonator 2, the electric coupling is attained.

Second Embodiment

Figure 6:
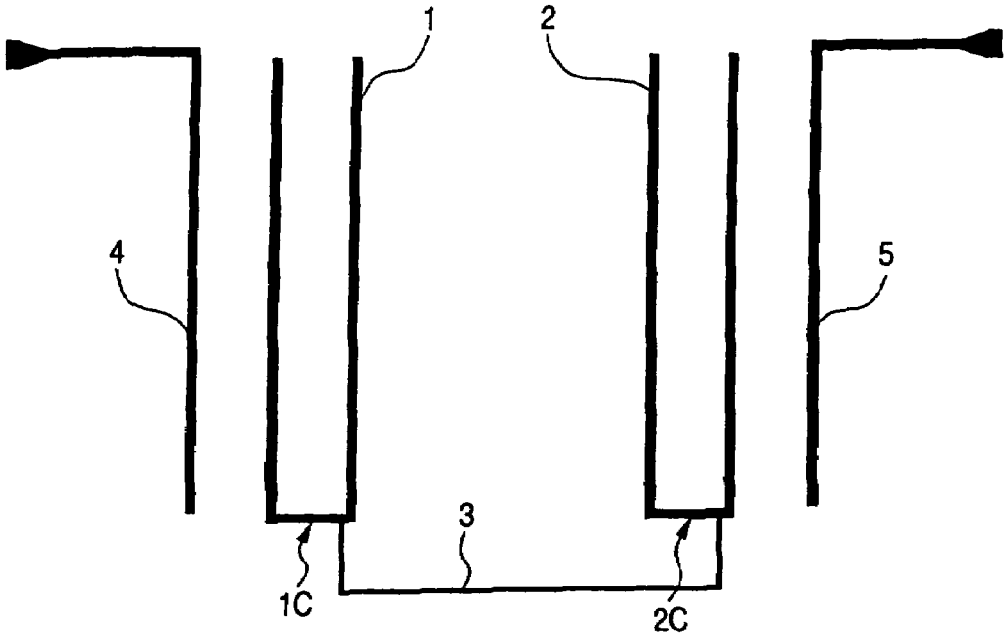
FIG. 6 is a pattern diagram illustrating the basic configuration of a filter circuit of second embodiment.

FIG. 6 is a pattern diagram illustrating the basic configuration of a filter circuit of second embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 1 and 2 are hairpin type half wavelength resonators. The resonance frequency is about 1.93 GHz. The resonators 1 and 2 are wire-coupled to each other by a transmission line 3 with a displaced pattern. In this pattern, the connecting position of the resonator 1 and the transmission line 3 is displaced toward the inside with respect to the center 1C of the resonator 1, and that of the resonator 2 and the transmission line 3 is displaced toward the outside with respect to the center 2C of the resonator 2.

In the embodiment also, the resonance frequency of the transmission line 3 is about 3.86 GHz. Namely, the resonance frequency is two times the resonance frequencies 1.93 GHz of the resonators 1 and 2.

The excitation portions 4 and 5 are connected to the external. In the circuit of FIG. 6, therefore, the coupling between the resonators 1 and 2 can be measured.

Figure 7:
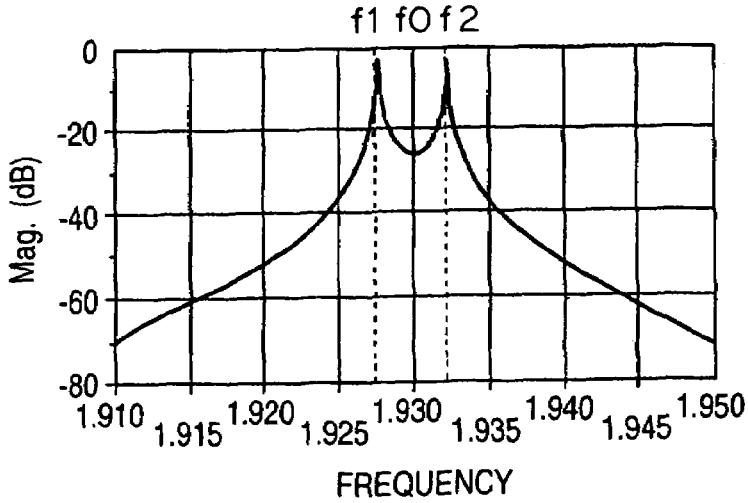
FIG. 7 is a diagram showing the pass amplitude characteristic of the filter circuit of the second embodiment.

FIG. 7 shows the pass strength characteristic of the circuit of FIG. 6. There are two peaks indicating the coupling between the two resonators. Assuming that the frequencies corresponding to the two peaks are respectively indicated by f1 and f2, the center f0 of the two peaks is given by the following equation.

$$f0=(f2+f1)/2$$

The center frequency f0 is about 1.93 GHz, and coincides with the resonance frequencies of the resonators 1 and 2. Conventionally, in a coupling between resonators using a coupling line, it is very difficult to prevent the resonance frequencies of the resonators from being deviated. By contrast, in the invention, resonators are wire-coupled to each other, whereby a coupling is realized without causing the resonance frequency to be deviated.

Figure 8:
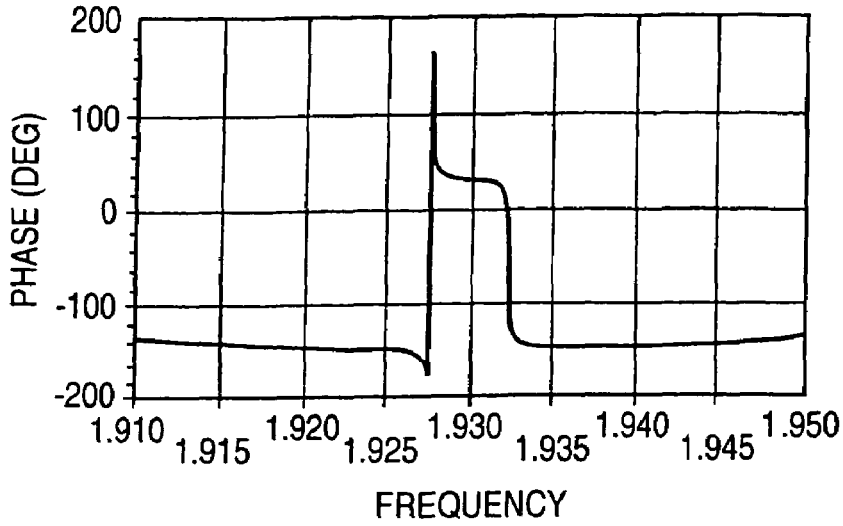
FIG. 8 is a diagram showing the pass phase characteristic of the filter circuit of the second embodiment.

FIG. 8 shows the pass phase characteristic of the circuit of FIG. 6. In FIG. 8, the phase leads in the frequency region corresponding to the interval of the two peaks in FIG. 7. Therefore, it will be seen that, in the circuit of FIG. 6, the coupling between the resonators 1 and 2 is a magnetic coupling.

Summarizing the above, when the resonators 1 and 2 are wire-coupled to each other through the transmission line 3 which resonates at a frequency that is two times the resonance frequencies of the resonators 1 and 2, the coupling between the resonators can be realized without causing the resonance frequency to be deviated. When the connecting position of the resonator 1 and the transmission line 3 is displaced toward the inside with respect to the center 1C of the resonator 1, and that of the resonator 2 and the transmission line 3 is displaced toward the outside with respect to the center 2C of the resonator 2, the magnetic coupling is attained.

Third Embodiment

Figure 9:
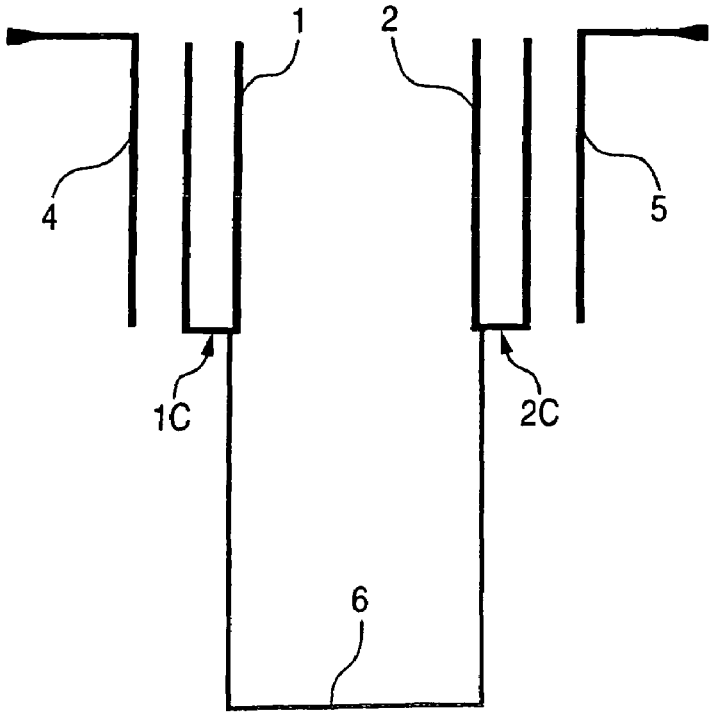
FIG. 9 is a pattern diagram illustrating the basic configuration of a filter circuit of third embodiment.

FIG. 9 is a pattern diagram illustrating the basic configuration of a filter circuit of third embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 1 and 2 are hairpin type half wavelength resonators. The resonance frequency is about 1.93 GHz. The resonators 1 and 2 are wire-coupled to each other through a transmission line 6. In this pattern, the connecting position of the resonator 1 and the transmission line 6 is displaced toward the inside with respect to the center 1C of the resonator 1, and also that of the resonator 2 and the transmission line 6 is displaced toward the inside with respect to the center 2C of the resonator 2.

In the embodiment, the transmission line 6 has a resonance frequency of about 1.287 GHz which is equal to two thirds of the resonance frequencies 1.93 GHz of the resonators.

The excitation portions 4 and 5 are connected to the external. In the circuit of FIG. 9, therefore, the coupling between the resonators 1 and 2 can be measured.

Figure 10:
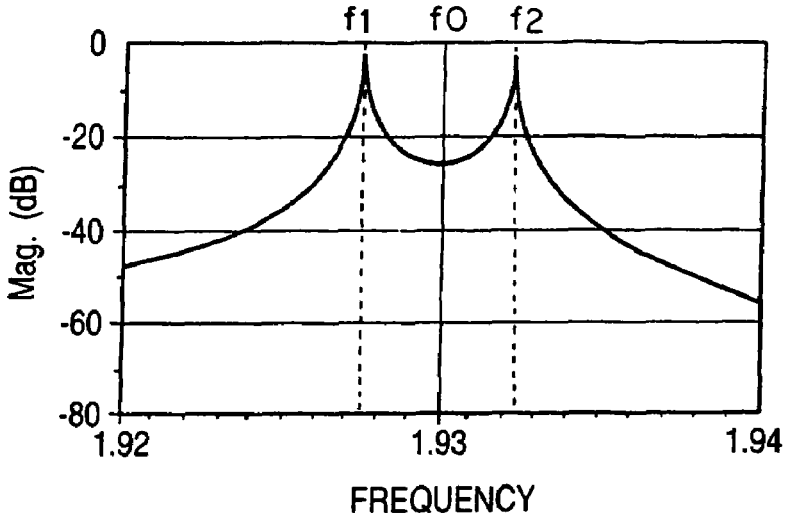
FIG. 10 is a diagram showing the pass amplitude characteristic of the filter circuit of third embodiment.

FIG. 10 shows the pass strength characteristic of the circuit of FIG. 9. There are two peaks indicating the coupling between the two resonators. Assuming that the frequencies corresponding to the two peaks are respectively indicated by f1 and f2, the center f0 of the two peaks is given by the following equation.

$$f0=(f2+f1)/2$$

The center frequency f0 is about 1.93 GHz, and coincides with the resonance frequencies of the resonators 1 and 2. Conventionally, in a coupling between resonators using a coupling line, it is very difficult to prevent the resonance frequencies of the resonators from deviating. By contrast, in the invention, resonators are wire-coupled to each other, whereby a coupling is realized without causing the resonance frequency to be deviated.

Figure 11:
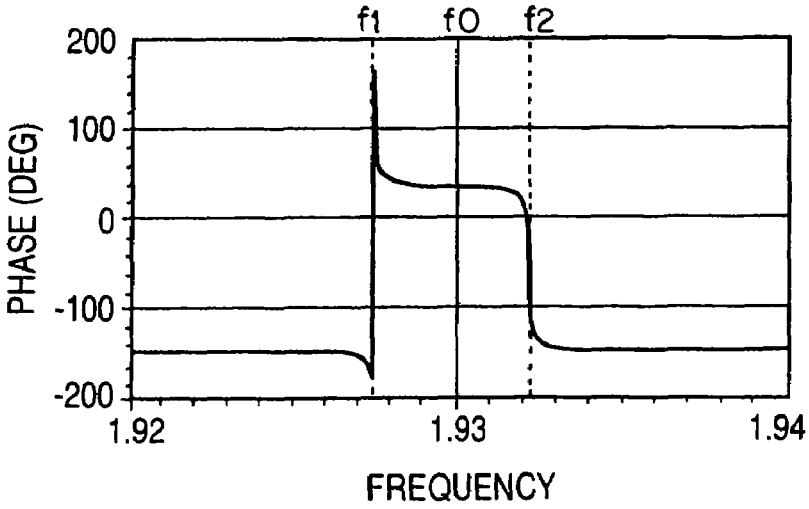
FIG. 11 is a diagram showing the pass phase characteristic of the filter circuit of third embodiment.

FIG. 11 shows the pass phase characteristic of the circuit of FIG. 9. Therefore, it will be seen that, in the circuit of FIG. 9, the coupling between the resonators 1 and 2 is the magnetic coupling.

Summarizing the above, when the resonators 1 and 2 are wire-coupled to each other through the transmission line 6 which resonates at a frequency that is equal to two thirds of the resonance frequencies of the resonators 1 and 2, the coupling between the resonators can be realized without causing the resonance frequency to be deviated. When the connecting position of the resonator 1 and the transmission line 6 is displaced toward the inside with respect to the center 1C of the resonator 1, and that of the resonator 2 and the transmission line 6 is displaced toward the outside with respect to the center 2C of the resonator 2, the magnetic coupling is attained.

Fourth Embodiment

Figure 12:
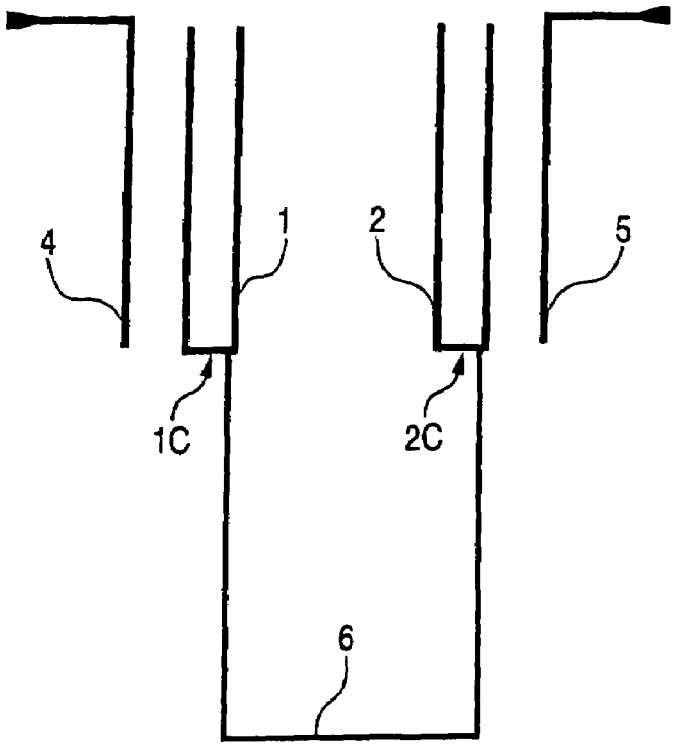
FIG. 12 is a pattern diagram illustrating the basic configuration of a filter circuit of fourth embodiment.

FIG. 12 is a pattern diagram illustrating the basic configuration of a filter circuit of fourth embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

Resonators 1 and 2 are hairpin type half wavelength resonators. The resonance frequency is about 1.93 GHz. The resonators 1 and 2 are wire-coupled to each other through a transmission line 6. In this pattern, the connecting position of the resonator 1 and the transmission line 6 is displaced toward the inside with respect to the center 1C of the resonator 1, and also that of the resonator 2 and the transmission line 6 is displaced toward the outside with respect to the center 2C of the resonator 2.

In the embodiment, the transmission line 6 has a resonance frequency of about 1.287 GHz which is equal two thirds of the resonance frequencies 1.93 GHz of the resonators.

The excitation portions 4 and 5 are connected to the external. In the circuit of FIG. 12, therefore, the coupling between the resonators 1 and 2 can be measured.

Figure 13:
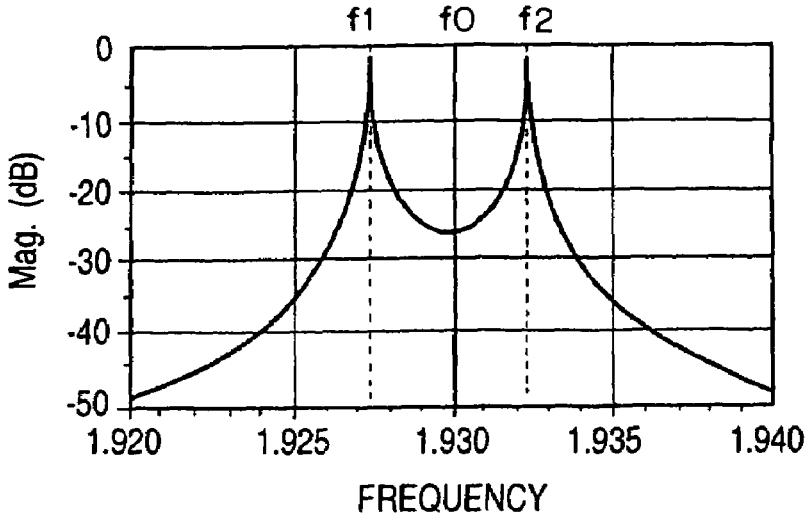
FIG. 13 is a diagram showing the pass amplitude characteristic of the filter circuit of fourth embodiment.

FIG. 13 shows the pass strength characteristic of the circuit of FIG. 12. There are two peaks indicating the coupling between the two resonators. Assuming that the frequencies corresponding to the two peaks are respectively indicated by f1 and f2, the center f0 of the two peaks is given by the following equation.

$$f0=(f2+f1)/2$$

The center frequency f0 is about 1.93 GHz, and coincides with the resonance frequencies of the resonators 1 and 2. Conventionally, in a coupling between resonators using a coupling line, it is very difficult to prevent the resonance frequencies of the resonators from deviating. By contrast, in the invention, resonators are wire-coupled to each other, whereby a coupling is realized without causing the resonance frequency to be deviated.

Figure 14:
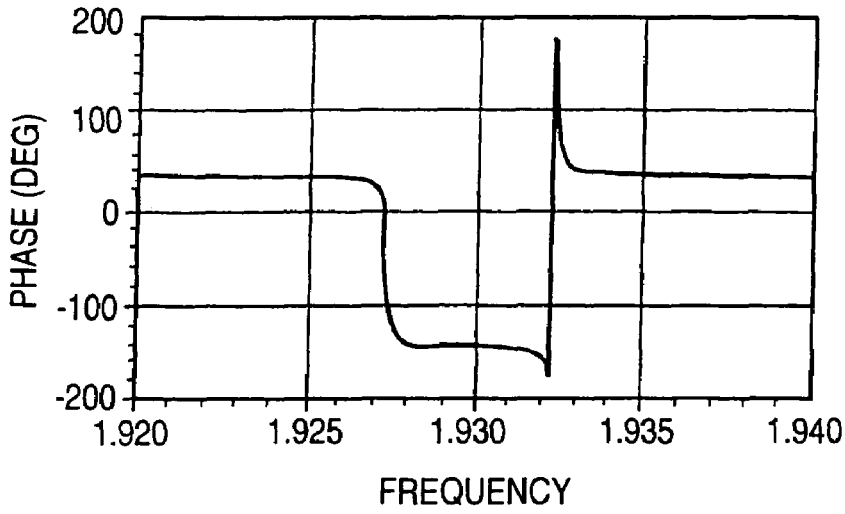
FIG. 14 is a diagram showing the pass phase characteristic of the filter circuit of fourth embodiment.

FIG. 14 shows the pass phase characteristic of the circuit of FIG. 12. Therefore, it will be seen that, in the circuit of FIG. 12, the coupling between the resonators 1 and 2 is the electric coupling.

Summarizing the above, when the resonators 1 and 2 are wire-coupled to each other through the transmission line 6 which resonates at a frequency that is equal to two thirds of the resonance frequencies of the resonators 1 and 2, the coupling between the resonators can be realized without causing the resonance frequency to be deviated. When the connecting position of the resonator 1 and the transmission line 6 is displaced toward the inside with respect to the center 1C of the resonator 1, and that of the resonator 2 and the transmission line 6 is displaced toward the outside with respect to the center 2C of the resonator 2, the electric coupling is attained.

Figure 37:
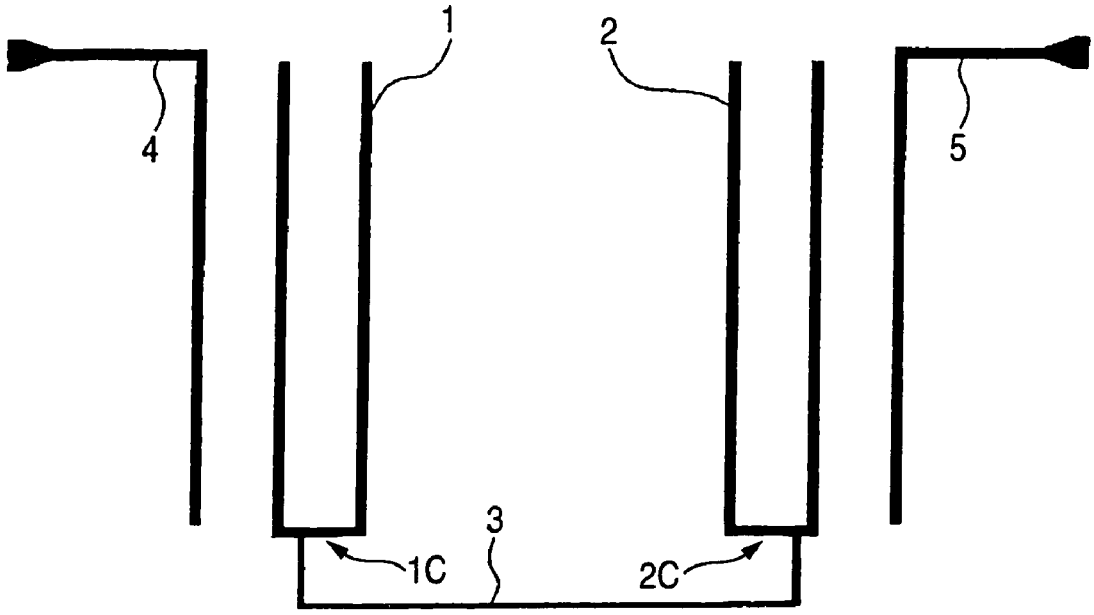
FIG. 37 is another pattern diagram illustrating the basic configuration of the filter circuit.
Figure 38:
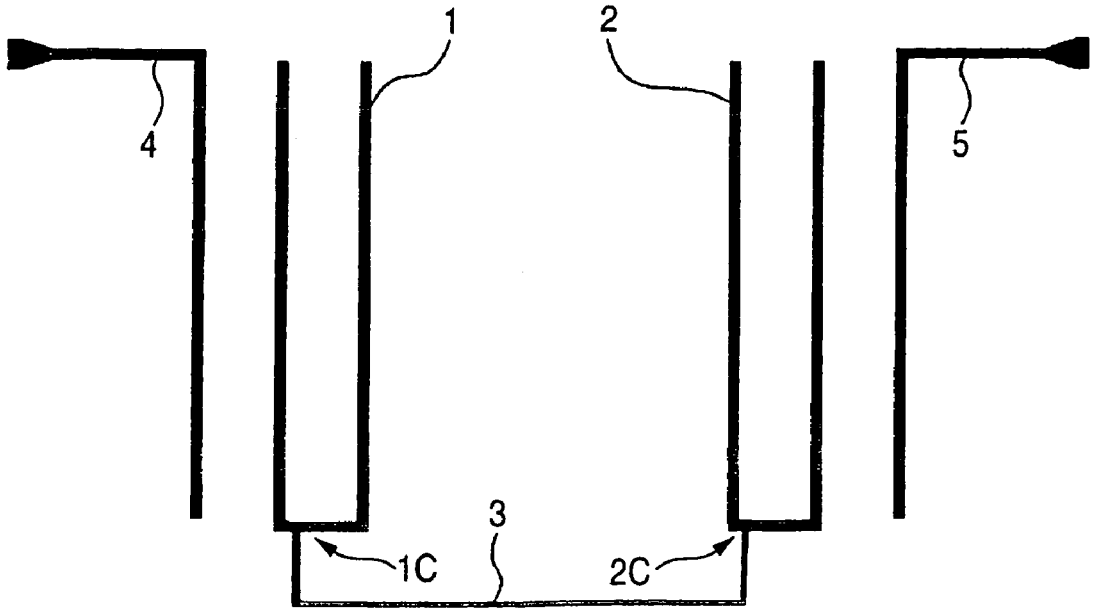
FIG. 38 is another pattern diagram illustrating the basic configuration of the filter circuit.

In place of the first and second embodiments shown in FIGS. 1 and 6, the patterns shown in FIGS. 37 and 38 may be employed. In the pattern shown in FIG. 37, the connecting position of the resonator 1 and the transmission line 3 is displaced toward the outside with respect to the center 1C of the resonator 1, and the connecting position of the resonator 2 and the transmission line 3 is displaced toward the outside with respect to the center 2C of the resonator 2. In the pattern shown in FIG. 38, the connecting position of the resonator 1 and the transmission line 3 is displaced toward the outside with respect to the center 1C of the resonator 1, and the connecting position of the resonator 2 and the transmission line 3 is displaced toward the inside with respect to the center 2C of the resonator 2.

According to the connecting positions of the transmission line and the resonators, either the electric coupling or the magnetic coupling is attained in the manner shown in the following table.

| Trasmission Line | Inside/Inside | Outside/Outside | Inside/ Ouside | Outside/ Inside |
|---|---|---|---|---|
| Two Times | X | X | Y | Y |
| Two Thirds | Y | Y | X | X |

In the above table, "Two Times" in "Transmission Line" column means that, as shown in FIG. 1 and the like, the resonance frequency of the transmission line 3 itself is two times the center frequency of the pass band of the filter, as well as "Two Thirds" in "Transmission Line" column means that, as shown in FIG. 9 and the like, the resonance frequency of the transmission line 6 itself is equal to two thirds of the center frequency. In the table, "Inside/Inside" shows the connecting positions of the transmission line with respect to the centers of the two resonators which are coupled through the transmission line, and means that the insides of the resonators are connected by the transmission line. This is similarly applicable also to the other expressions such as "Outside/Outside".

In the table, the symbols "X" and "Y" show the kinds of couplings (the electric coupling and the magnetic coupling), respectively. However, the symbol X means an electric coupling or a magnetic coupling depending on the patterns of the used resonators. Actually, the kinds of couplings respectively corresponding to the symbols "X" and "Y" must be determined for each pattern. When the kind of coupling in one element in Table 1 is once determined, Table 1 can be completed.

In FIG. 1, for example, the inside coupling is conducted in the resonator 1, and the inside coupling is conducted in the resonator 2. Therefore, the pattern of the figure corresponds to "Inside/Inside" in the table. The resonance frequency of the transmission line is two times the resonance frequencies of the resonators. Therefore, this case corresponds to the element of the first row and the second column, and the kind of coupling is X. As referred to FIG. 3, it is seen that the kind of coupling is the electric coupling. As a result, it is determined that "X" is the electric coupling and "Y" is the magnetic coupling.

Figure 15:
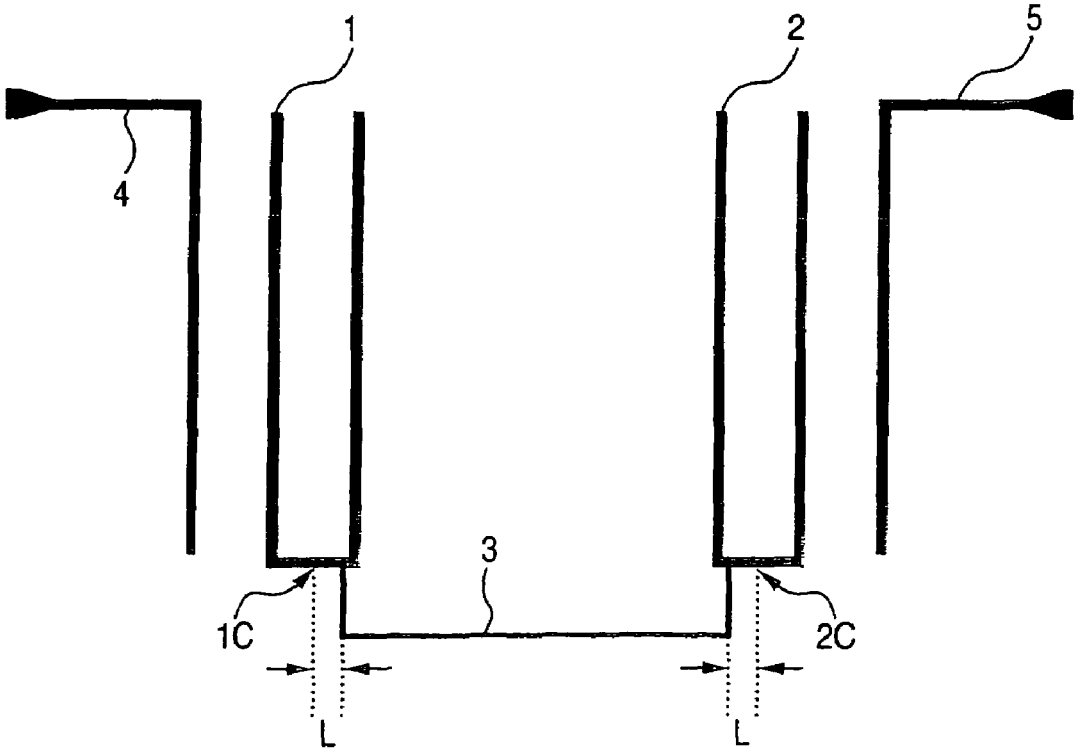
FIG. 15 is a pattern diagram illustrating the basic configuration of the filter circuit of first embodiment.

FIG. 15 shows the circuit of FIG. 1. The distance between the connecting position of a resonator and the transmission line, and the center 1C or 2C of the resonator is indicated by "L".

Figure 16:
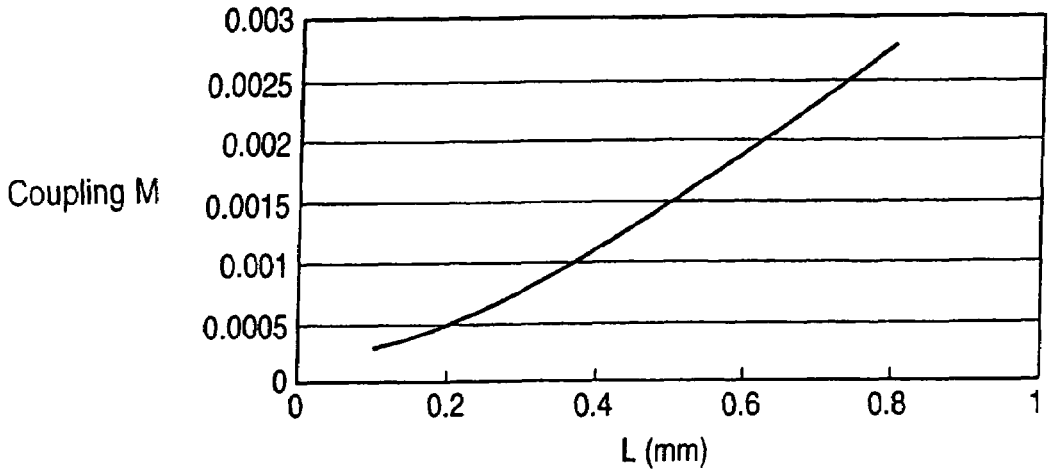
FIG. 16 is a view showing relationships between a connecting position of a transmission line and a resonator, and the coupling coefficient.

The values of the coupling coefficient M in the case where "L" is variously changed are shown in FIG. 16. In FIG. 16, the abscissa indicates L (mm), and the ordinate indicates the coupling coefficient M. As seen from the figure, it is possible to realize a desired coupling by adjusting the connecting position of a resonator and the transmission line. In this example, both of the resonators 1 and 2 are displaced by the same distance. Alternatively, the resonators 1 and 2 may be displaced by different distances.

Fifth Embodiment

Figure 17:
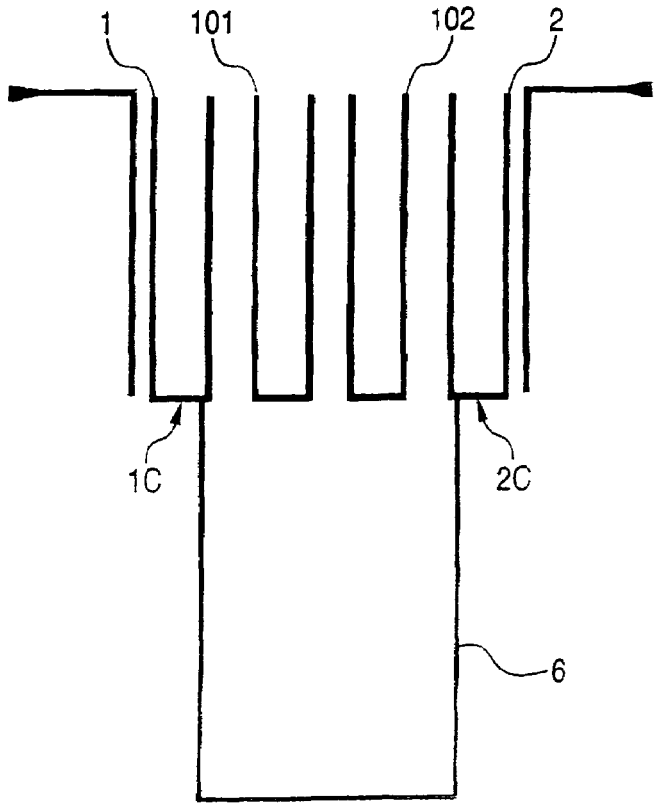
FIG. 17 is a pattern diagram of a filter circuit of fifth embodiment.

FIG. 17 is a view illustrating a pattern of a filter circuit of fifth embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

The embodiment is a four-stage filter configured by four hairpin type resonators 1, 101, 102, 2. Each resonator has a resonance frequency of about 1.93 GHz.

The resonators 1, 101, 102, 2 are electrically coupled in this sequence, so that a block is configured by the four resonators. The resonators 1 and 2 serve as end resonators of the block.

The transmission line 6 has a resonance frequency of about 1.287 GHz which is equal to two thirds of the resonance frequencies 1.93 GHz of the resonators. The resonators 1 and 2 are wire-coupled to each other through the transmission line 6. The connecting position of the resonator 1 and the transmission line 6 is displaced toward the inside with respect to the center 1C of the resonator 1, and that of the resonator 2 and the transmission line 6 is displaced toward the inside with respect to the center 2C of the resonator 2. Therefore, the coupling between the resonators 1 and 2 through the transmission line 6 is the magnetic coupling.

Therefore, the couplings between the resonators 101 and 102, and the resonators 1 and 2 are in opposite phase, and realize a pure imaginary zero of a transfer function.

Figure 18:
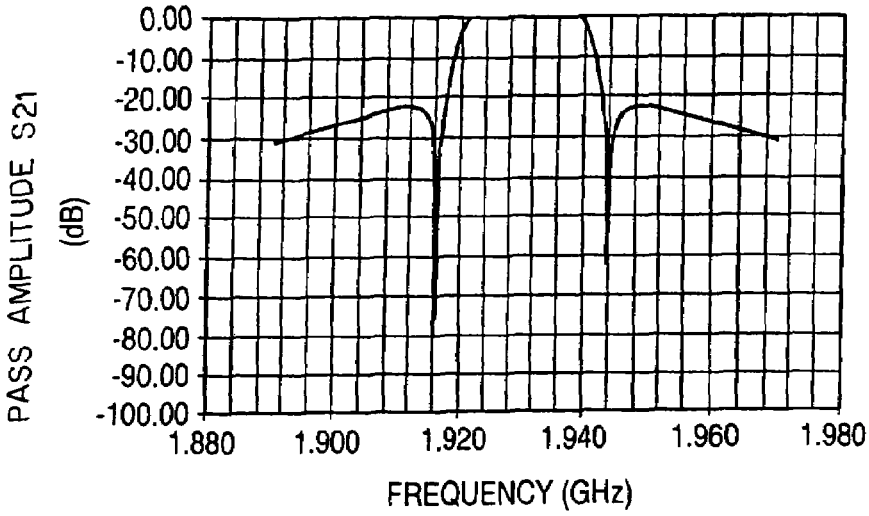
FIG. 18 is a diagram showing the pass amplitude characteristic of the filter circuit of the fifth embodiment.

FIG. 18 shows the pass amplitude characteristic of the filter shown in FIG. 17. The characteristic shows an example of a normalized low-pass filter in which the transfer function has a zero at ±1.7j where j is the imaginary unit.

The center frequency of the filter is about 1.93 GHz, and the band width of the filter is about 20 MHz. The pass strength is substantially constant in the pass band, and begins to attenuate at frequencies of about 1.92 GHz and 1.94 GHz.

In the embodiment, an attenuation pole due to the pure imaginary zero of the transfer function exists on each of the sides of the pass band, and a steep skirt characteristic is realized.

In the embodiment, the resonators are of the hairpin type. Alternatively, various kinds of resonators such as open-loop type resonators or meander open-loop resonators may be used.

In the embodiment, the circuit is configured by a microstrip line. Alternatively, the circuit may be configured by a strip line.

Sixth Embodiment

Figure 19:
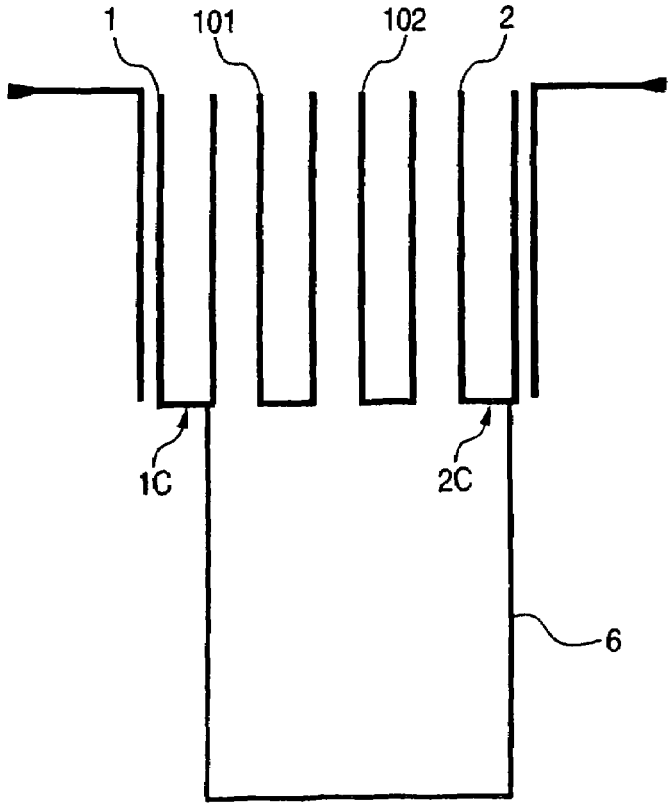
FIG. 19 is a pattern diagram of a filter circuit of sixth embodiment.

FIG. 19 is a view illustrating a pattern of a filter of sixth embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

The embodiment is a four-stage filter configured by four hairpin type resonators 1, 101, 102, 2. Each resonator has a resonance frequency of about 1.93 GHz.

The resonators 1, 101, 102, 2 are electrically coupled in this sequence, so that a block is configured by the four resonators. The resonators 1 and 2 serve as end resonators of the block.

In FIG. 19, the coupling between the resonators 1 and 2 is the electric coupling.

The transmission line 6 has a resonance frequency of about 1.287 GHz which is equal to two thirds of the resonance frequencies 1.93 GHz of the resonators.

The resonators 1 and 2 are wire-coupled to each other through the transmission line 6. The connecting position of the resonator 1 and the transmission line 6 is displaced toward the inside with respect to the center 1C of the resonator 1, and that of the resonator 2 and the transmission line 6 is displaced toward the outside with respect to the center 2C of the resonator 2. Therefore, the coupling between the resonators 1 and 2 through the transmission line 6 is the electric coupling.

Therefore, the couplings between the resonators 101 and 102, and the resonators 1 and 2 are in phase, and realize a real zero of a transfer function.

Figure 20:
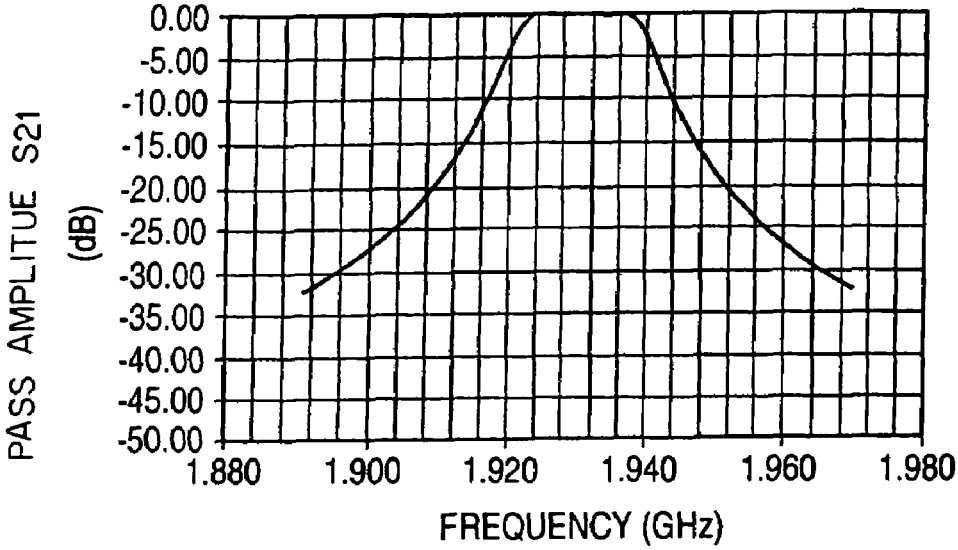
FIG. 20 is a diagram showing the pass amplitude characteristic of the filter circuit of the sixth embodiment.

FIG. 20 shows the pass amplitude characteristic of the filter shown in FIG. 19. The characteristic shows an example of a normalized low-pass filter in which the transfer function has a real zero at ±1.4.

The center frequency of the filter is about 1.93 GHz, and the band width of the filter is about 20 MHz. The pass strength is substantially constant in the pass band, and begins to attenuate at frequencies of about 1.92 GHz and 1.94 GHz.

Figure 21:
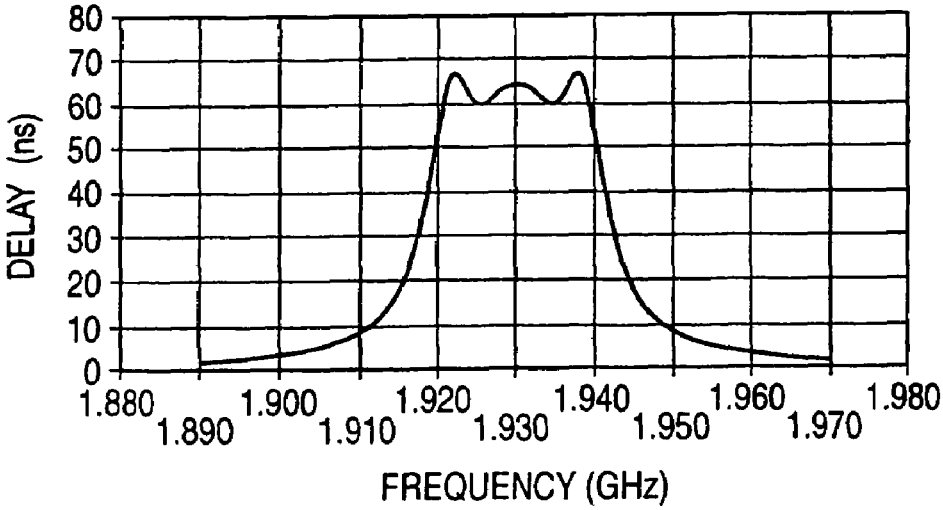
FIG. 21 is a diagram showing the group delay characteristic of the filter circuit of the sixth embodiment.

FIG. 21 shows the group delay characteristic of the filter. A flat group delay characteristic in the pass band is realized by a real zero of the transfer function.

In the embodiment, the resonators are of the hairpin type. Alternatively, various kinds of resonators such as open-loop type resonators or meander open-loop resonators may be used.

In the embodiment, the circuit is configured by a microstrip line. Alternatively, the circuit may be configured by a strip line.

Seventh Embodiment

Figure 22:
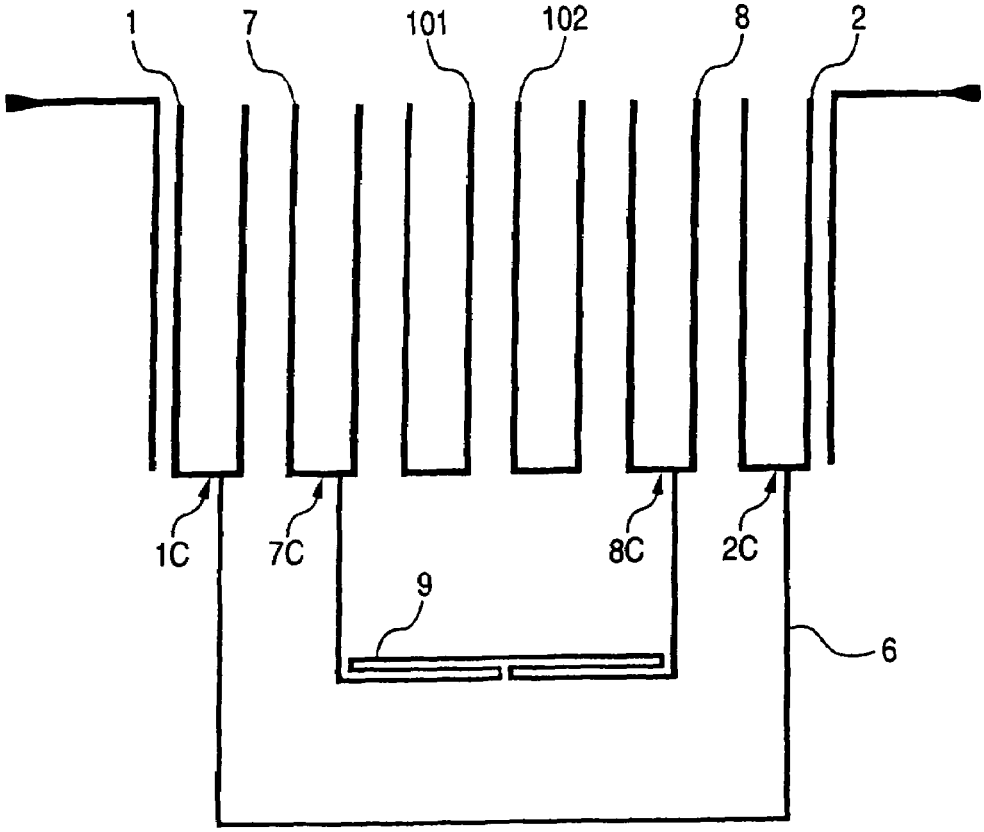
FIG. 22 is a pattern diagram of a filter circuit of a seventh embodiment.

FIG. 22 is a view illustrating a pattern of a filter of seventh embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

The embodiment is a six-stage filter configured by six hairpin type resonators 1, 7, 101, 102, 8, 2. Each resonator has a resonance frequency of about 1.93 GHz.

The resonators 1, 7, 101, 102, 8, 2 are electrically coupled in this sequence, so that a block is configured by the six resonators. The resonators 1 and 2 serve as end resonators of the block.

The transmission line 6 has a resonance frequency of about 1.287 GHz which is equal to two thirds of the resonance frequencies 1.93 GHz of the resonators.

The resonators 1 and 2 are wire-coupled to each other through the transmission line 6. The connecting position of the resonator 1 and the transmission line 6 is displaced toward the inside with respect to the center 1C of the resonator 1, and that of the resonator 2 and the transmission line 6 is displaced toward the outside with respect to the center 2C of the resonator 2. Therefore, the coupling between the resonators 1 and 2 through the transmission line 6 is the electric coupling.

The transmission line 9 has a resonance frequency of about 1.287 GHz which is equal to two thirds of the resonance frequencies 1.93 GHz of the resonators. The resonators 7 and 8 are wire-coupled to each other through the transmission line 9. The connecting position of the resonator 7 and the transmission line 9 is displaced toward the inside with respect to the center 7C of the resonator 7, and that of the resonator 8 and the transmission line 9 is displaced toward the outside with respect to the center 8C of the resonator 8. Therefore, the coupling between the resonators 7 and 8 through the transmission line 9 is the electric coupling.

Therefore, the couplings between the resonators 101 and 102, the resonators 7 and 8, and the resonators 1 and 2 are in phase, and realize a complex zero of a transfer function.

Figure 23:
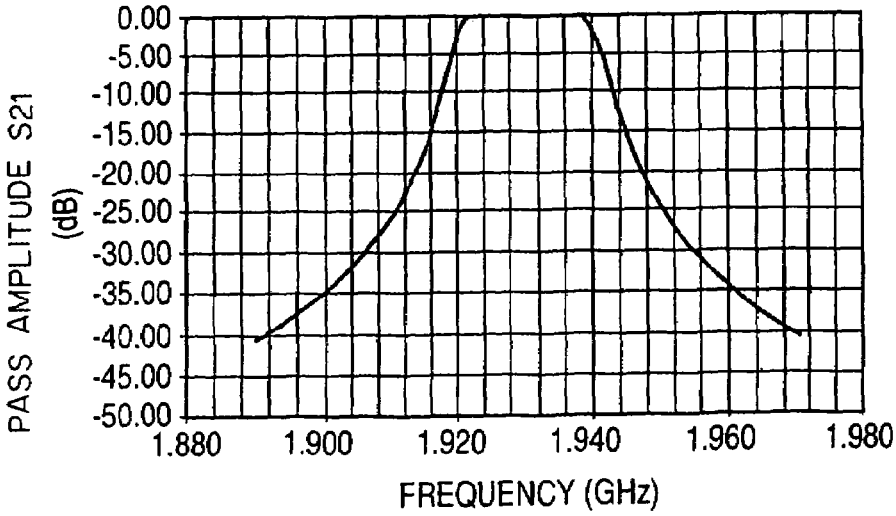
FIG. 23 is a diagram showing the pass amplitude characteristic of the filter circuit of the seventh embodiment.

FIG. 23 shows the pass amplitude characteristic of the filter shown in FIG. 22. The characteristic shows an example of a normalized low-pass filter in which the transfer function has a zero at $\pm(1\pm0.4j)$ where j is the imaginary unit.

The center frequency of the filter is about 1.93 GHz, and the band width of the filter is about 20 MHz. The pass strength is substantially constant in the pass band, and begins to attenuate at frequencies of about 1.92 GHz and 1.94 GHz.

Figure 24:
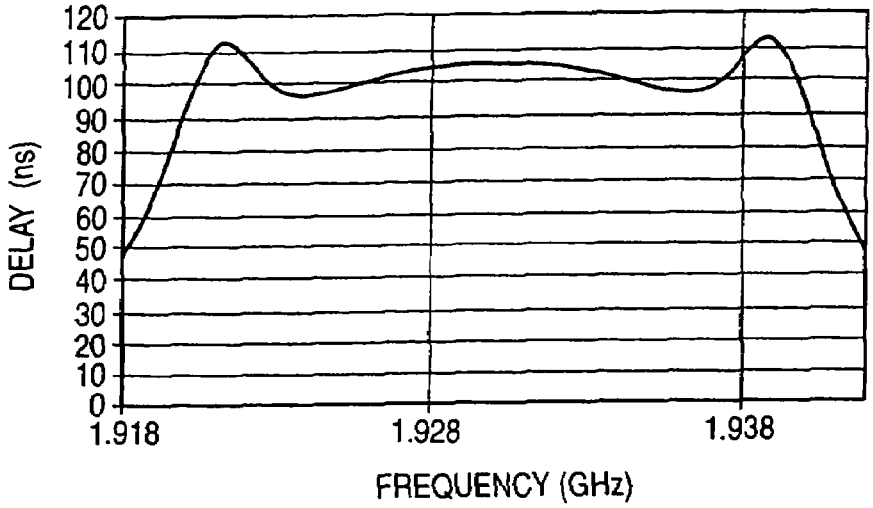
FIG. 24 is a diagram showing the group delay characteristic of the filter circuit of the seventh embodiment.

FIG. 24 shows the group delay characteristic of the filter. A flat group delay characteristic in the pass band is realized by a complex zero of the transfer function.

In the embodiment, the resonators are of the hairpin type. Alternatively, various kinds of resonators such as open-loop type resonators or meander open-loop resonators may be used.

In the embodiment, the circuit is configured by a microstrip line. Alternatively, the circuit may be configured by a strip line.

Eighth Embodiment

Figure 25:
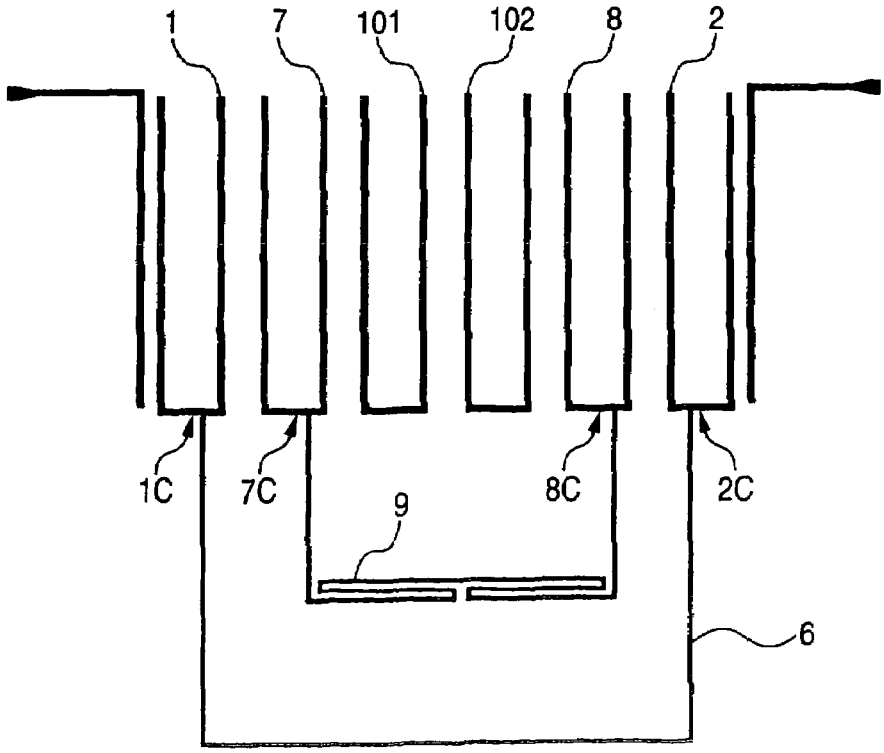
FIG. 25 is a pattern diagram of a filter circuit of eighth embodiment.

FIG. 25 is a view illustrating a pattern of a filter of an eighth embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

The embodiment is a six-stage filter configured by six hairpin type resonators 1, 7, 101, 102, 8, 2. Each resonator has a resonance frequency of about 1.93 GHz.

The resonators 1, 7, 101, 102, 8, 2 are electrically coupled in this sequence, so that a block is configured by the six resonators. The resonators 1 and 2 serve as end resonators of the block.

The transmission line 6 has a resonance frequency of about 1.287 GHz which is equal to two thirds of the resonance frequencies 1.93 GHz of the resonators. The resonators 1 and 2 are wire-coupled to each other through the transmission line 6. The connecting position of the resonator 1 and the transmission line 6 is displaced toward the inside with respect to the center 1C of the resonator 1, and that of the resonator 2 and the transmission line 6 is displaced toward the inside with respect to the center 2C of the resonator 2. Therefore, the coupling between the resonators 1 and 2 through the transmission line 6 is the magnetic coupling.

The transmission line 9 has a resonance frequency of about 1.287 GHz which is equal to two thirds of the resonance frequencies 1.93 GHz of the resonators. The resonators 7 and 8 are wire-coupled to each other through the transmission line 9. The connecting position of the resonator 7 and the transmission line 9 is displaced toward the inside with respect to the center 7C of the resonator 7, and that of the resonator 8 and the transmission line 9 is displaced toward the outside with respect to the center 8C of the resonator 8. Therefore, the coupling between the resonators 7 and 8 through the transmission line 9 is the electric coupling.

Therefore, the couplings between the resonators 101 and 102, and the resonators 7 and 8 are in phase, and those between the resonators 7 and 8, and the resonators 1 and 2 are in opposite phase. Therefore, one set of pure imaginary zeros of a transfer function, and one set of real zeros are realized.

Figure 26:
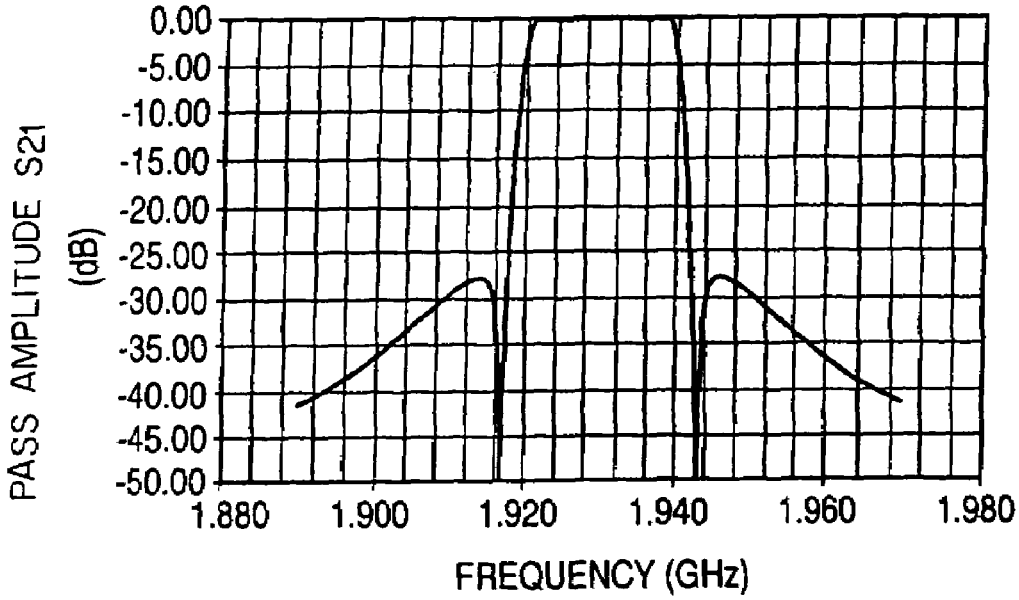
FIG. 26 is a diagram showing the pass amplitude characteristic of the filter circuit of the eighth embodiment.

FIG. 26 shows the pass amplitude characteristic of the filter shown in FIG. 25. The characteristic shows an example of a normalized low-pass filter in which the transfer function has a pure imaginary zero at ±1.5j and a real zero at ±1.2, where j is the imaginary unit.

The center frequency of the filter is about 1.93 GHz, and the band width of the filter is about 20 MHz. The pass strength is substantially constant in the pass band, and begins to attenuate at frequencies of about 1.92 GHz and 1.94 GHz. In the embodiment, an attenuation pole due to the pure imaginary zero of the transfer function exists on each of the sides of the pass band, and a steep skirt characteristic is realized.

Figure 27:
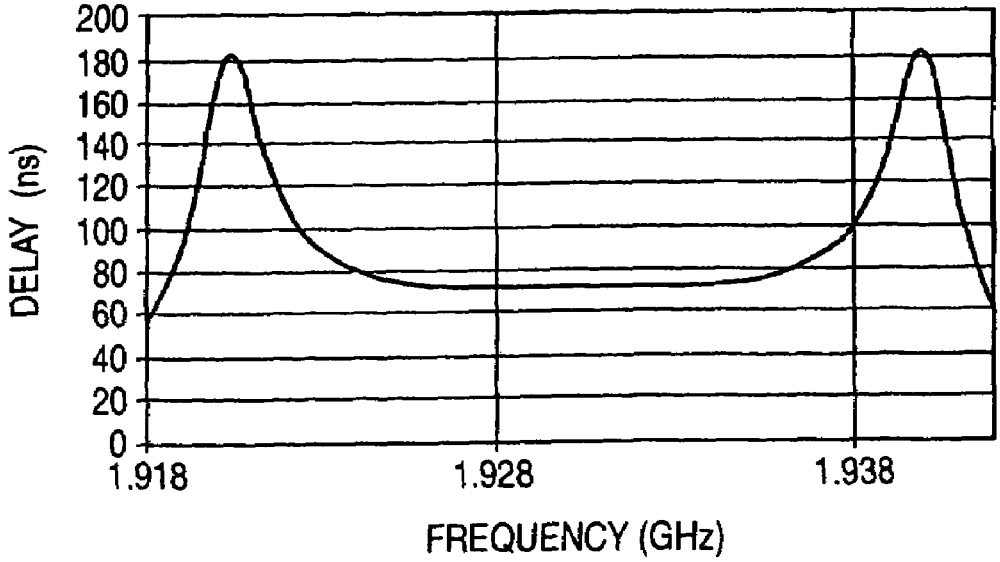
FIG. 27 is a diagram showing the group delay characteristic of the filter circuit of the eighth embodiment.

FIG. 27 shows the group delay characteristic of the filter. A flat group delay characteristic in the pass band is realized by a real zero of the transfer function.

In the embodiment, the resonators are of the hairpin type. Alternatively, various kinds of resonators such as open-loop type resonators or meander open-loop resonators may be used.

In the embodiment, the circuit is configured by a microstrip line. Alternatively, the circuit may be configured by a strip line.

Ninth Embodiment

Figure 28:
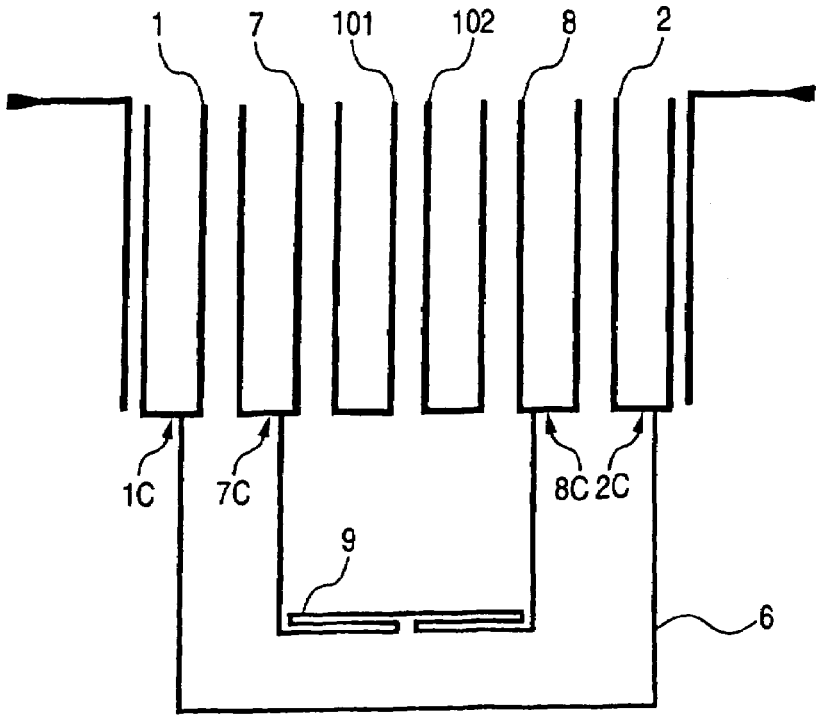
FIG. 28 is a pattern diagram of a filter circuit of the ninth embodiment.

FIG. 28 is a view illustrating a pattern of a filter of a ninth embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

The embodiment is a six-stage filter configured by six hairpin type resonators 1, 7, 101, 102, 8, 2. Each resonator has a resonance frequency of about 1.93 GHz.

The resonators 1, 7, 101, 102, 8, 2 are electrically coupled in this sequence, so that a block is configured by the six resonators. The resonators 1 and 2 serve as end resonators of the block.

The transmission line 6 has a resonance frequency of about 1.287 GHz which is equal to two thirds of the resonance frequencies 1.93 GHz of the resonators. The resonators 1 and 2 are wire-coupled to each other through the transmission line 6. The connecting position of the resonator 1 and the transmission line 6 is displaced toward the inside with respect to the center 1C of the resonator 1, and that of the resonator 2 and the transmission line 6 is displaced toward the outside with respect to the center 2C of the resonator 2. Therefore, the coupling between the resonators 1 and 2 through the transmission line 6 is the electric coupling.

The transmission line 9 has a resonance frequency of about 1.287 GHz which is equal to two thirds of the resonance frequencies 1.93 GHz of the resonators. The resonators 7 and 8 are wire-coupled to each other through the transmission line 9. The connecting position of the resonator 7 and the transmission line 9 is displaced toward the inside with respect to the center 7C of the resonator 7, and that of the resonator 8 and the transmission line 9 is displaced toward the inside with respect to the center 8C of the resonator 8. Therefore, the coupling between the resonators 7 and 8 through the transmission line 9 is the magnetic coupling.

Therefore, the couplings between the resonators 101 and 102, and the resonators 7 and 8 are in opposite phase, and also those between the resonators 7 and 8, and the resonators 1 and 2 are in opposite phase. Therefore, two sets of a pure imaginary zero of a transfer function are realized.

Figure 29:
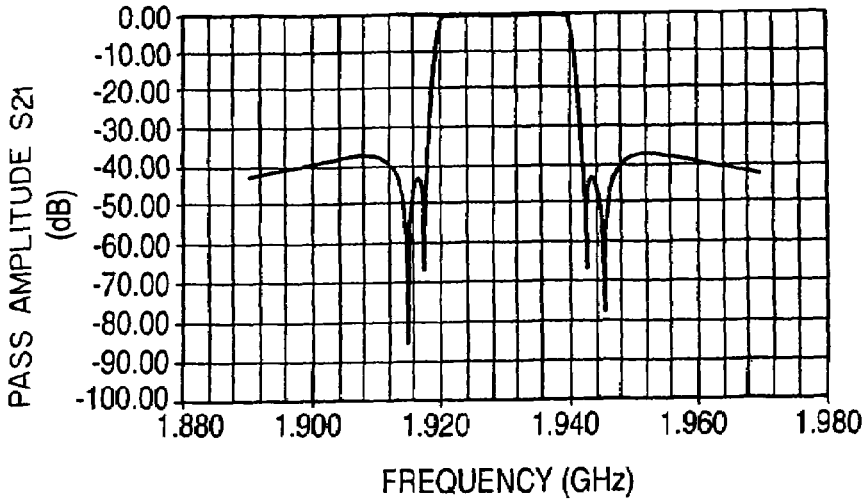
FIG. 29 is a diagram showing the pass amplitude characteristic of the filter circuit of the ninth embodiment.

FIG. 29 shows the pass amplitude characteristic of the filter shown in FIG. 28. The characteristic shows an example of a normalized low-pass filter in which the transfer function has a zero at ±1.4j and ±1.7j where j is the imaginary unit.

The center frequency of the filter is about 1.93 GHz, and the band width of the filter is about 20 MHz. The pass strength is substantially constant in the pass band, and begins to attenuate at frequencies of about 1.92 GHz and 1.94 GHz. In the embodiment, two attenuation poles due to the pure imaginary zero of the transfer function exist on each of the sides of the pass band, and a steep skirt characteristic is realized.

In the embodiment, the resonators are of the hairpin type. Alternatively, various kinds of resonators such as open-loop type resonators or meander open-loop resonators may be used.

In the embodiment, the circuit is configured by a microstrip line. Alternatively, the circuit may be configured by a strip line.

Tenth Embodiment

Figure 30:
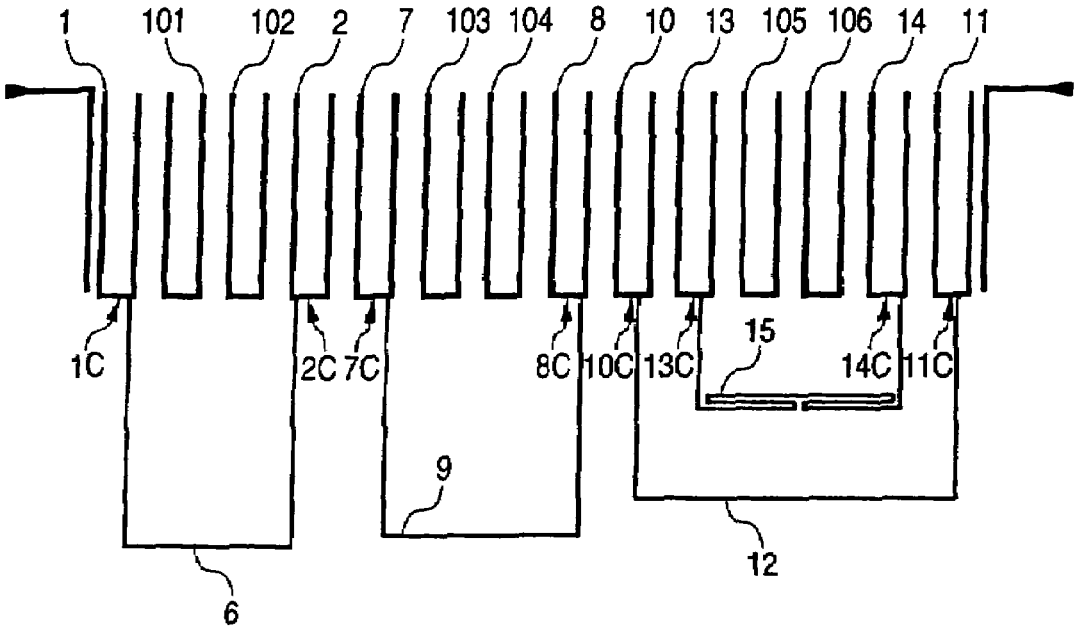
FIG. 30 is a pattern diagram of a filter circuit of tenth embodiment.

FIG. 30 is a view illustrating a pattern of a filter of a tenth embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

The embodiment is a fourteen-stage filter configured by fourteen hairpin type resonators 1, 101, 102, 2, 7, 103, 104, 8, 10, 13, 105, 106, 14, 11. Each resonator has a resonance frequency of about 1.93 GHz.

The resonators 1, 101, 102, 2, 7, 103, 104, 8, 10, 13, 105, 106, 14, 11 are electrically coupled in this sequence, so that a block is configured by the four resonators 1, 101, 102, 2, a block is configured by the four resonators 7, 103, 104, 8, and a block is configured by the six resonators 10, 13, 105, 106, 14, 11. The resonators 1 and 2 serve as end resonators of the block.

The transmission line 6 has a resonance frequency of about 1.287 GHz which is equal to two thirds of the resonance frequencies 1.93 GHz of the resonators. The resonators 1 and 2 are wire-coupled to each other through the transmission line 6. The connecting position of the resonator 1 and the transmission line 6 is displaced toward the inside with respect to the center 1C of the resonator 1, and that of the resonator 2 and the transmission line 6 is displaced toward the inside with respect to the center 2C of the resonator 2. Therefore, the coupling between the resonators 1 and 2 through the transmission line 6 is the magnetic coupling.

Therefore, the couplings between the resonators 101 and 102, and the resonators 1 and 2 are in opposite phase, and realize one set of pure imaginary zeros of a transfer function.

The resonators 7 and 8 serve as end resonators of the block. In FIG. 30, the coupling between the resonators 103 and 104 is the electric coupling.

The transmission line 9 has a resonance frequency of about 1.287 GHz which is equal to two thirds of the resonance frequencies 1.93 GHz of the-resonators. The resonators 7 and 8 are wire-coupled to each other through the transmission line 9. The connecting position of the resonator 7 and the transmission line 9 is displaced toward the inside with respect to the center 7C of the resonator 7, and that of the resonator 8 and the transmission line 9 is displaced toward the outside with respect to the center 8C of the resonator 8. Therefore, the coupling between the resonators 7 and 8 through the transmission line 9 is the electric coupling.

Therefore, the couplings between the resonators 103 and 104, and the resonators 7 and 8 are in phase, and realize one set of real zeros of a transfer function.

The resonators 10 and 11 serve as end resonators of the block. In FIG. 30, the coupling between the resonators 105 and 106 is the electric coupling.

A transmission line 12 has a resonance frequency of about 1.287 GHz which is equal to two thirds of the resonance frequencies 1.93 GHz of the resonators. The resonators 10 and 11 are wire-coupled to each other through the transmission line 12. The connecting position of the resonator 10 and the transmission line 12 is displaced toward the inside with respect to the center 10C of the resonator 10, and that of the resonator 11 and the transmission line 12 is displaced toward the outside with respect to the center 11C of the resonator 11. Therefore, the coupling between the resonators 10 and 11 through the transmission line 12 is the electric coupling.

A transmission line 15 has a resonance frequency of about 1.287 GHz which is equal to two thirds of the resonance frequencies 1.93 GHz of the resonators. The resonators 13 and 14 are wire-coupled to each other through the transmission line 15. The connecting position of the resonator 13 and the transmission line 15 is displaced toward the inside with respect to the center 13C of the resonator 13, and that of the resonator 14 and the transmission line 15 is displaced toward the outside with respect to the center 14C of the resonator 14. Therefore, the coupling between the resonators 13 and 14 through the transmission line 15 is the electric coupling.

Therefore, the couplings between the resonators 105 and 106, the resonators 13 and 14, and the resonators 10 and 11 are in phase, and realize one set of complex zeros of a transfer function.

Figure 31:
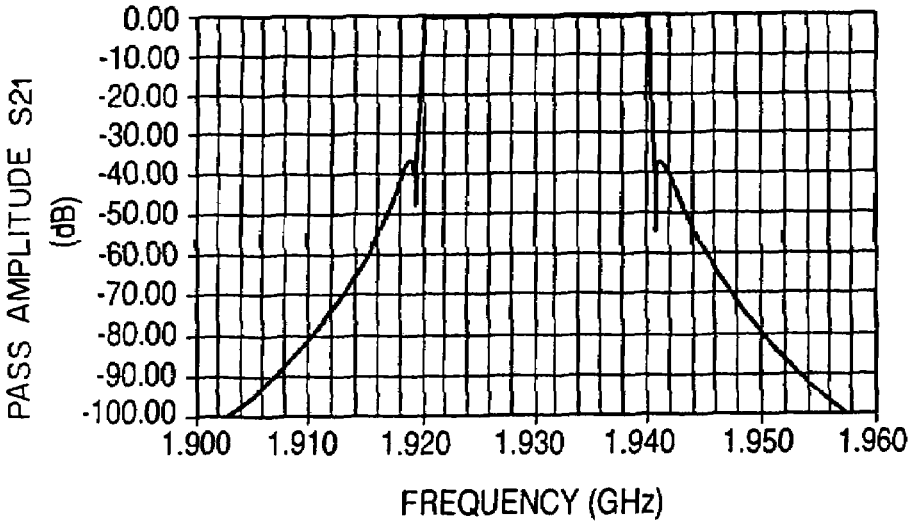
FIG. 31 is a diagram showing the pass amplitude characteristic of the filter circuit of the tenth-embodiment.

FIG. 31 shows the pass amplitude characteristic of the filter shown in FIG. 30. The characteristic shows an example of a normalized low-pass filter in which the transfer function has a complex zero at $\pm(0.7\pm0.7j)$, a pure imaginary zero at $\pm1.1\,j$, and a real zero at $\pm0.65$, where j is the imaginary unit.

The center frequency of the filter is about 1.93 GHz, and the band width of the filter is about 20 MHz. The pass strength is substantially constant in the pass band, and begins to attenuate at frequencies of about 1.92 GHz and 1.94 GHz. In the embodiment, one attenuation pole due to the pure imaginary zero of the transfer function exists on each of the sides of the pass band, and a steep skirt characteristic is realized.

Figure 32:
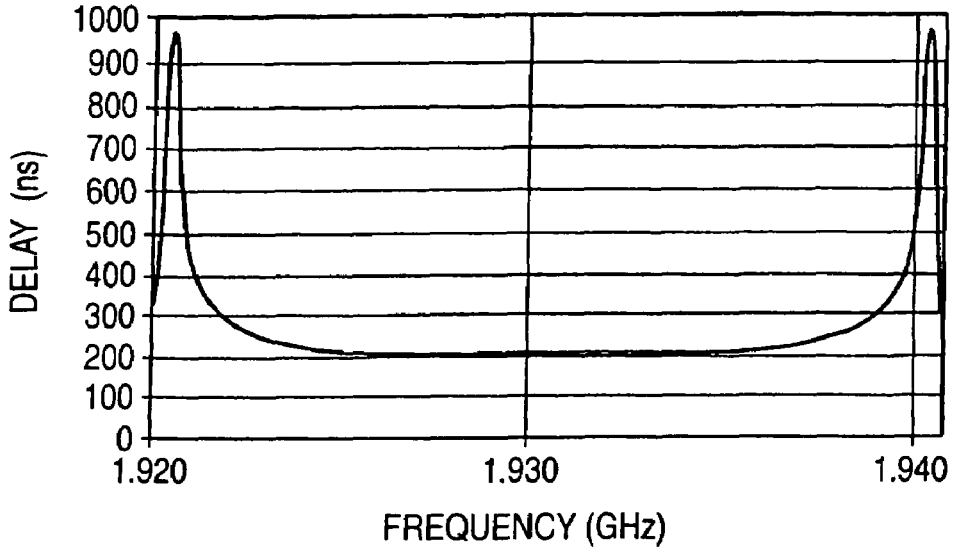
FIG. 32 is a diagram showing the group delay characteristic of the filter circuit of the tenth embodiment.

FIG. 32 shows the group delay characteristic of the filter. A flat group delay characteristic in the pass band is realized by a complex zero and a real zero of the transfer function.

In the embodiment, the resonators are of the hairpin type. Alternatively, various kinds of resonators such as open-loop type resonators or meander open-loop resonators may be used.

In the embodiment, the circuit is configured by a microstrip line. Alternatively, the circuit may be configured by a strip line.

Eleventh Embodiment

Figure 33:
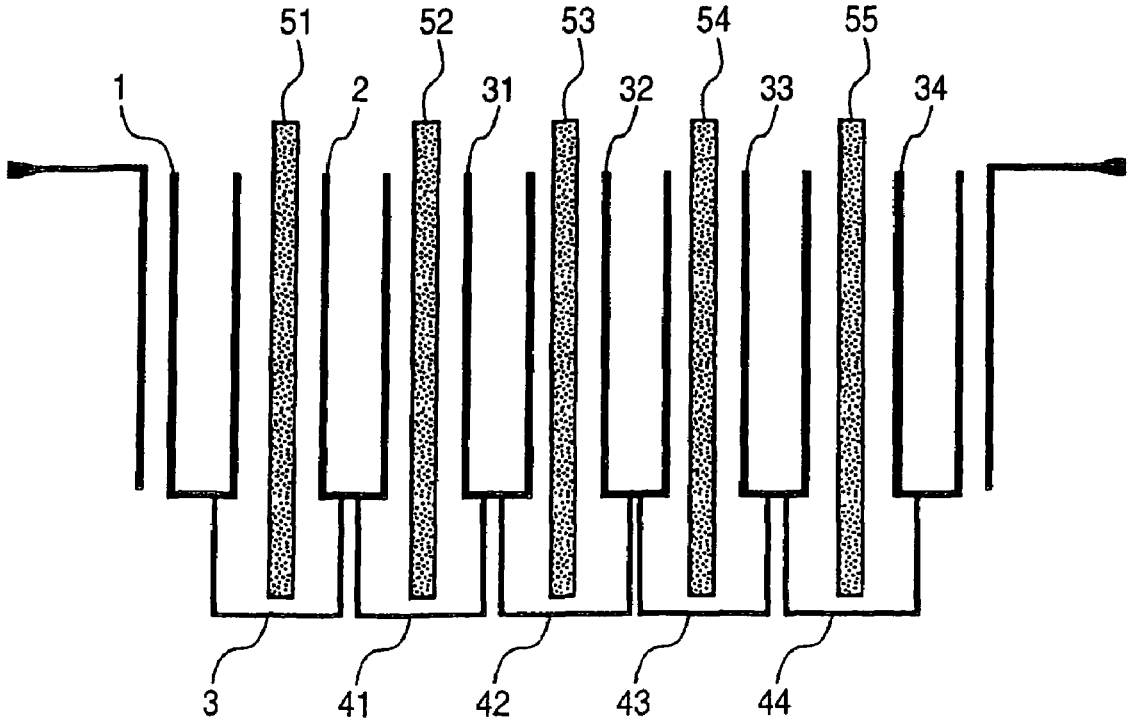
FIG. 33 is a pattern diagram of a filter circuit of eleventh embodiment.

FIG. 33 is a view illustrating a pattern of a filter of an eleventh embodiment.

A superconductor microstrip line is formed on an MgO substrate (not shown) having a thickness of about 0.43 mm and a specific dielectric constant of about 10. In the filter, a thin film of a Y-based copper oxide high temperature superconductor having a thickness of about 500 nm is used as the superconductor of a microstrip line, and a strip conductor has a line width of about 0.4 mm. The superconductor thin film can be formed by the laser deposition method, the sputtering method, the codeposition method, or the like.

The embodiment is a six-stage filter configured by six hairpin type resonators 1, 2, 31, 32, 33, 34. Each resonator has a resonance frequency of about 1.93 GHz.

The resonators 1, 2, 31, 32, 33, 34 are coupled in this sequence by transmission lines 3, 41, 42, 43, 44.

The transmission lines 3, 41, 42, 43, 44 have a resonance frequency of about 3.86 GHz which is two times the resonance frequencies 1.93 GHz of the resonators.

The resonators 1 and 2 are wire-coupled to each other through the transmission line 3. The resonators 2 and 31 are wire-coupled to each other through the transmission line 41. The resonators 31 and 32 are wire-coupled to each other through the transmission line 42. The resonators 32 and 33 are wire-coupled to each other through the transmission line 43. The resonators 33 and 34 are wire-coupled to each other through the transmission line 44.

Partition walls 51, 52, 53, 54, 55 are copper plates which are electrically grounded, and prevent undesired couplings between the resonators from being generated.

Namely, all the couplings between the resonators are realized by the transmission lines, and undesired couplings between the resonators are prevented by the partition walls from being generated.

Figure 34:
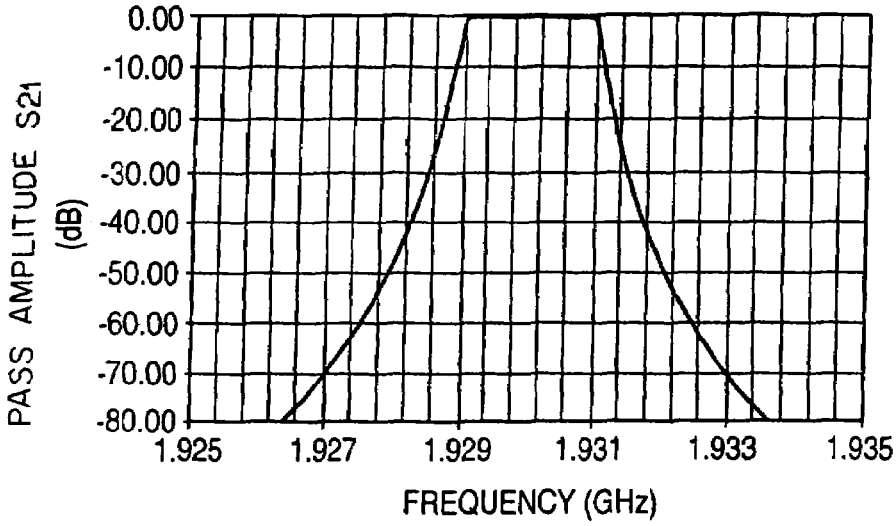
FIG. 34 is a diagram showing the pass amplitude characteristic of the filter circuit of the eleventh embodiment.

FIG. 34 shows the pass amplitude characteristic of the filter shown in FIG. 33. The center frequency of the filter is about 1.93 GHz, and the band width of the filter is about 20 MHz. The pass strength is substantially constant in the pass band, and begins to attenuate at frequencies of about 1.929 GHz and 1.931 GHz.

In order to attain such a narrow pass band, a very weak coupling between resonators must be stably realized. Therefore, such a narrow pass band is hardly realized by a resonator coupling without using a transmission line. In a conventional coupling with a transmission line, the resonance frequencies of resonators deviates, and hence it is difficult to realize all resonator couplings by using a transmission line. Namely, such a narrow pass band can be realized for the first time by the invention.

Twelfth Embodiment

Figure 35:
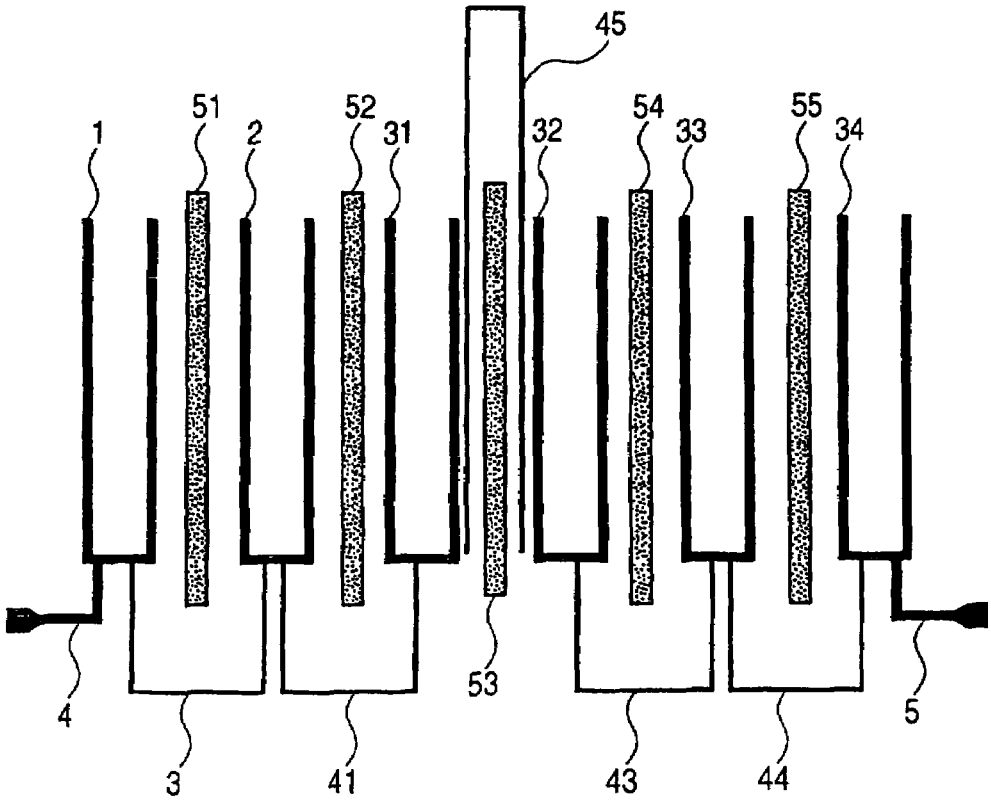
FIG. 35 is a pattern diagram of a filter circuit of twelfth embodiment.

FIG. 35 is a view illustrating a pattern of a twelfth embodiment. The pattern of FIG. 35 shows a six-stage filter configured by six hairpin type resonators 1, 2, 31, 32, 33, 34. The resonators have a resonance frequency of about 1.93 GHz.

The resonators 1, 2, 31, 32, 33, 34 are coupled in this sequence by transmission lines 3, 41, 45, 43, 44.

The transmission lines 3, 41, 45, 43, 44 have a resonance frequency of about 3.86 GHz which is two times the resonance frequencies 1.93 GHz of the resonators. The transmission line 45 has a resonance frequency of about 1.287 GHz which is equal to two thirds of the resonance frequencies 1.93 GHz of the resonators.

The resonators 1 and 2 are wire-coupled to each other through the transmission line 3. The resonators 2 and 31 are wire-coupled to each other through the transmission line 41. The resonators 32 and 33 are wire-coupled to each other through the transmission line 43. The resonators 33 and 34 are wire-coupled to each other through the transmission line 44.

The transmission line 45 is not wire-coupled to the resonators 31 and 32, and gaps are formed therebetween. In other words, the resonators 31 and 32 are coupled to each other through a coupling line of a conventional type having gaps.

Partition walls 51, 52, 53, 54, 55 are copper plates which are electrically grounded, and prevent undesired couplings between the resonators from being generated.

Namely, all the couplings between the resonators are realized by the transmission lines, and undesired couplings between the resonators are prevented by the partition walls from being generated.

In FIG. 35, the excitation portions 4 and 5 are coupled to the resonators through directly connected taps in place of gaps. It is possible to realize the resonator coupling through transmission lines in a same manner regardless of whether the excitation is conducted through a tap or a gap.

The filter of FIG. 35 shows characteristics similar to those of FIG. 34.

Thirteenth Embodiment

Figure 36:
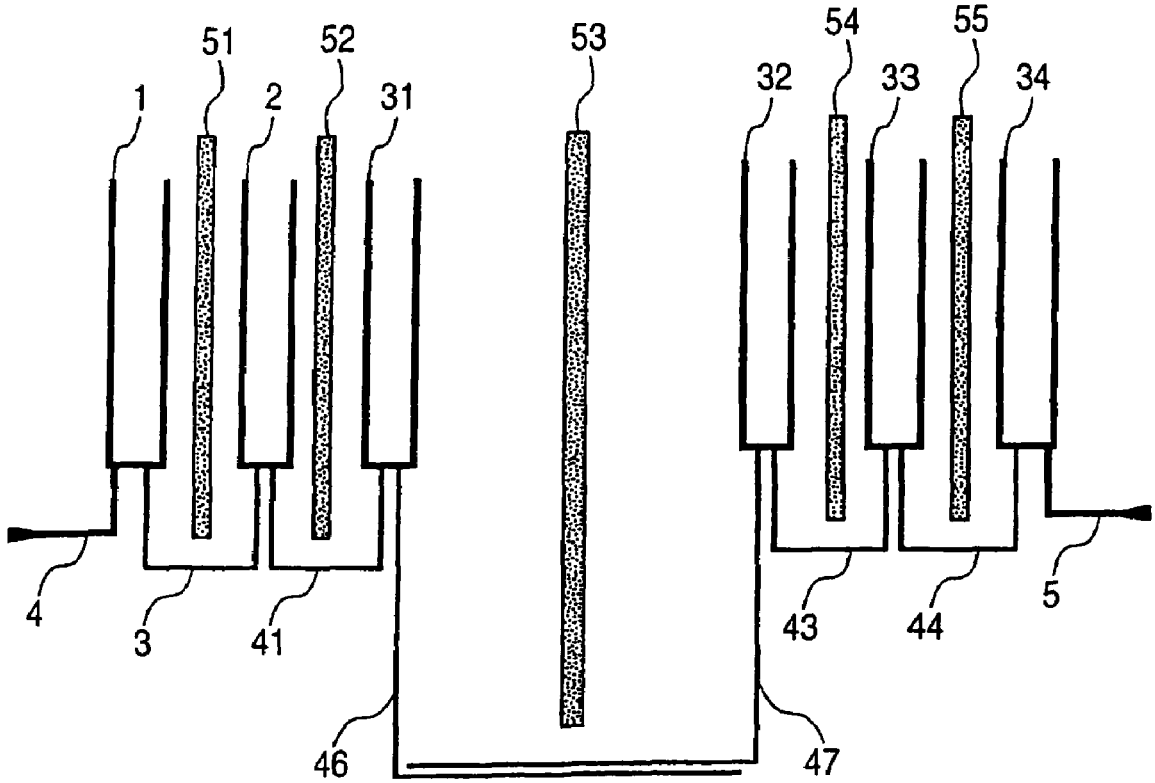
FIG. 36 is a pattern diagram of a filter circuit of thirteenth embodiment.

FIG. 36 is a view illustrating a pattern of the filter of a thirteenth embodiment. The pattern of FIG. 36 shows a six-stage filter configured by six hairpin type resonators 1, 2, 31, 32, 33, 34. Each resonator has a resonance frequency of about 1.93 GHz.

The resonators 1, 2, 31, 32, 33, 34 are coupled in this sequence through transmission lines 3, 41, 46, and 47, 43, 44.

The transmission lines 3, 41, 43, 44 have a resonance frequency of about 3.86 GHz which is two times the resonance frequencies 1.93 GHz of the resonators. The resonance frequencies of the transmission lines 46, 47 are equal to the resonance frequencies 1.93 GHz of the resonators.

The resonators 1 and 2 are wire-coupled to each other through the transmission line 3. The resonators 2 and 31 are wire-coupled to each other through the transmission line 41. The resonators 32 and 33 are wire-coupled to each other through the transmission line 43. The resonators 33 and 34 are wire-coupled to each other through the transmission line 44.

One end of the transmission line 46 is wire-coupled to the resonator 31, and another end of the transmission line 46 is opened and laterally coupled to the transmission line 47 via a gap. One end of the transmission line 47 is wire-coupled to the resonator 32, and another end of the transmission line 47 is opened and laterally coupled to the transmission line 46 via a gap. Namely, the coupling between the resonators 31 and 32 is realized by the transmission lines 46, 47.

Partition walls 51, 52, 53, 54, 55 are copper plates which are electrically grounded, and prevent undesired couplings between the resonators from being generated.

Namely, all the couplings between the resonators are realized by the transmission lines, and undesired couplings between the resonators are prevented by the partition walls from being generated.

In FIG. 36, the excitation portions 4 and 5 are coupled to the resonators through directly connected taps in place of gaps.

The filter of FIG. 36 shows characteristics similar to those of FIG. 34. In the embodiment, the resonators are of the hairpin type. Alternatively, various kinds of resonators such as open-loop type resonators or meander open-loop resonators may be used.

In the embodiment, the circuit is configured by a microstrip line. Alternatively, the circuit may be configured by a strip line.

Figure 39:
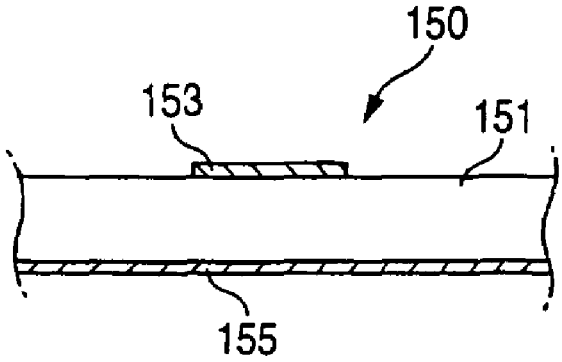
FIG. 39 is a partial section view of the filter.

FIG. 39 is a partial section view of the filter of the above embodiments. As shown in FIG. 39, the filter 150 has an MgO substrate 151 having a specific dielectric constant of about 10, a strip line 153 which is formed on the upper face of the MgO substrate 151, and a grounding conductor 155 which is formed on the entire lower face of the MgO substrate 151.

However, since MgO deliquesces, i.e. it can dissolve or become liquid by absorption of moisture or water, MgO has a problem if it gets in contact with moisture or water. Therefore, a sapphire ($A1_2O_3$) substrate may be used in place of the MgO substrate 151. In the sapphire substrate, the dielectric loss is very small or $10^{-7}$ to $10^{-8}$, and the crystal structure is stable. Therefore, the sapphire substrate has an advantage that the dielectric constant in the substrate is stabilized. As compared with an MgO substrate, a sapphire substrate has further advantages that it has an excellent mechanical strength, that it has a high thermal conductivity, and that it is economical.

Figure 40:
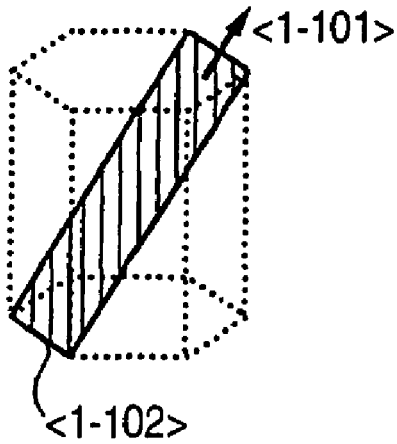
FIG. 40 is a diagram illustrating <1-101> direction of a sapphire crystal.

Preferably, a substrate in which the (1-102) plane (R-plane) shown in FIG. 40 is cut out (hereinafter, "sapphire R-plane substrate") is used as the sapphire substrate. In this case, the strip line 153 is formed on the R-plane. Since the sapphire R-plane substrate has a dielectric constant anisotropy, the impedance matching at a connecting position of a transmission line and a resonator may not be attained, thereby causing the possibility that the filter characteristic is degraded.

Figure 41:
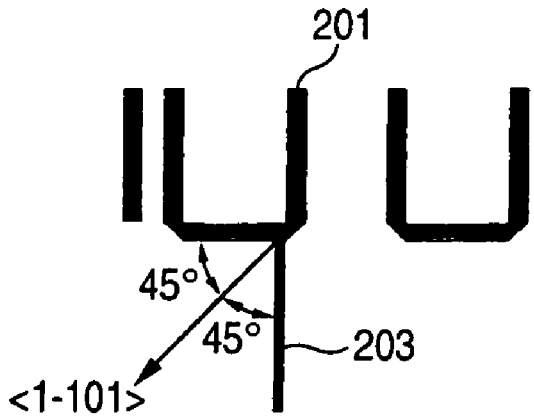
FIG. 41 is a diagram illustrating an angle which <1-101> direction forms with a transmission line and a resonator.

In the example, as shown in FIG. 41, at a connecting position of a transmission line 203 and a resonator 201, the angle formed by the transmission line 203 and the <1-101> direction shown in FIG. 40 is 45°, and the angle formed by the resonator 201 and the <1-101> direction is 45° or 135°. Therefore, the dielectric constant in the direction of the transmission line 203 is equal to that in the direction of the resonator 201, so that the impedance matching at the connecting position is attained. As a result, it is possible to obtain an excellent filter characteristic.

Figure 42:
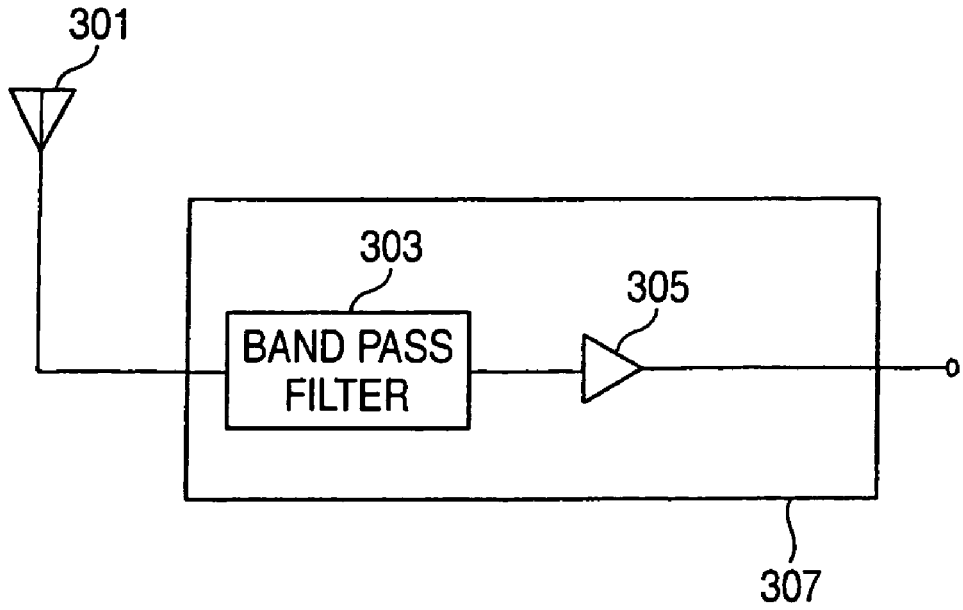
FIG. 42 is a block diagram showing a part of such a radio communication apparatus.

The band pass filter which has been described above can be used in, for example, a radio communication apparatus. FIG. 42 is a block diagram showing a part of such a radio communication apparatus. As shown in FIG. 42, the radio communication apparatus involves an antenna 301 for transmitting or receiving a radio signal, a band pass filter 303, and a low noise amplifier 305.

The band pass filter 303 is disposed between the antenna 301 and the low noise amplifier 305. The radio communication apparatus further involves a low-temperature holding portion 307 which holds the band pass filter 303 and the low noise amplifier 305 to a low temperature. Since the band pass filter 303 and the low noise amplifier 305 are held to a low temperature by the low-temperature holding portion 307, thermal noises of the low noise amplifier 305 are reduced, so that the noise figure (NF) is improved. In order to enable resonators of the band pass filter 303 to maintain the superconductive property, the filter must be held to a low temperature.

Figure 43:
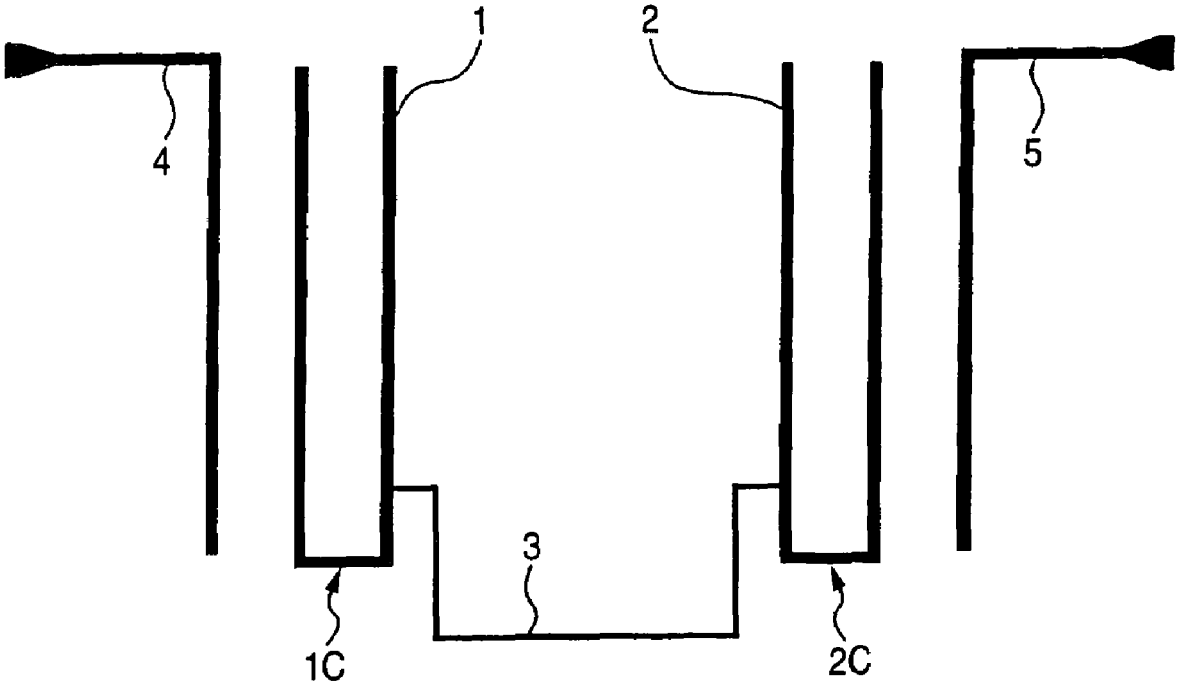
FIG. 43 is another pattern diagram illustrating the configuration of a filter circuit of the first embodiment.

In the above embodiments, the transmission lines are respectively connected to the portion where is closer to the center of the resonators, as shown in FIGS. 1, 6, 9, 12, 15, 17, 19, 22, 25, 28, 30, 33, 35 and 36. However, the transmission lines may be connected to the other portion where is a half wavelength portion of the resonators as shown in FIG. 43.

As described above, a filter circuit using a coupling line which can stably realize a strong coupling without causing deviation of the resonance frequencies of resonators can be provided.

What is claimed is:

1. A band pass filter comprising:

a first resonator for resonating at a center frequency of a pass band;

a second resonator for resonating at the center frequency; and a first transmission line for wire-coupling between said first resonator and said second resonator, wherein a first connecting position of said first resonator and said first transmission line is located at a first position different from a center of said first resonator, and a second connecting position of said second resonator and said first transmission line is located at a second position different from a center of said second resonator;

wherein said first transmission line resonates at a frequency which is 2/(2n−1) times higher than the center frequency (where n is a natural number).

2. The band pass filter according to claim 1, wherein said first resonator and said second resonator are half wavelength resonators.

3. The band pass filter according to claim 1, wherein said first resonator and said second resonator are coupled to each other only through said first transmission line.

4. The band pass filter according to claim 1, wherein said first connecting position is placed on an inside with respect to the center of said first resonator, and said second connecting position is placed on an outside with respect to the center of said second resonator.

5. The band pass filter according to claim 1, wherein said first connecting position is placed on an inside relative to the center of the first resonator and said second connecting position is placed on an inside relative to the center of said second resonator.

6. The band pass filter according to claim 1, wherein at least one of said first resonator and said second resonator is comprised of a superconducting member.

7. A band pass filter comprising:

a first resonator for resonating at a center frequency of a pass band;

a second resonator for resonating at the center frequency;

third and fourth resonators, which are placed between said first resonator and said second resonator, for resonating at the center frequency; and a first transmission line for wire-coupling between said first resonator and said second resonator, wherein a first connecting position of said first resonator and said first transmission line is located at a first position different from a center of said first resonator, and a second connecting position of said second resonator and said first transmission line is located at a second position different from a center of said second resonator, and said first connecting position is placed on an inside relative to the center of the first resonator and said second connecting position is placed on an inside relative to the center of said second resonator.

8. The band pass filter according to claim 7, wherein said first resonator and said second resonator are coupled to each other only through said first transmission line.

9. The band pass filter according to claim 7, wherein at least one of said first resonator and said second resonator is comprised of a superconducting member.

10. The band pass filter according to claim 7, wherein said first resonator and said second resonator are half wavelength resonators.

11. A band pass filter comprising:

a first resonator for resonating at a center frequency of a pass band;

a second resonator for resonating at the center frequency;

third and fourth resonators, which are placed between said first resonator and said second resonator, for resonating at the center frequency; and a first transmission line for wire-coupling between said first resonator and said second resonator, wherein a first connecting position of said first resonator and said first transmission line is located at a first position different from a center of said first resonator, and a second connecting position of said second resonator and said first transmission line is located at a second position different from a center of said second resonator, and a second transmission line for wire-coupling between said third resonator and said fourth resonator.

12. A band pass filter comprising:

a first resonator for resonating at a center frequency of a pass band;

a second resonator for resonating at the center frequency; and a first transmission line for wire-coupling between said first resonator and said second resonator, wherein a first connecting position of said first resonator and said first transmission line is located at a first position different from a center of said first resonator, and a second connecting position of said second resonator and said first transmission line is located at a second position different from a center of said second resonator;

wherein said first connecting position is placed on an inside relative to the center of said first resonator, and said second connecting position is placed on an outside relative to the center of said second resonator; and wherein said first transmission line resonates at a frequency which is $2/(2n-1)$ times higher than the center frequency, n being a natural number.

13. The band pass filter according to claim 12, wherein said first resonator and said second resonator are half wavelength resonators.

14. The band pass filter according to claim 12, wherein said first resonator and said second resonator are coupled to each other only through said first transmission line.

15. The band pass filter according to claim 12, wherein at least one of said first resonator and said second resonator is comprised of a superconducting member.

16. The band pass filter according to claim 12, further comprising:

third and fourth resonators, which are placed between said first resonator and said second resonator, for resonating at the center frequency; and a second transmission line for wire-coupling between said third resonator and said fourth resonator.

* * * * *